US005289213A

United States Patent [19]

Murai et al.

[11] Patent Number: 5,289,213

[45] Date of Patent: Feb. 22, 1994

[54] LIQUID JET RECORDING APPARATUS WITH HUMIDIFYING MEANS

[75] Inventors: Keiichi Murai, Kashiwa; Hiroshi Sugitani, Machida; Masami Ikeda, Tokyo; Mitsuru Kurata, Kawasaki; Hiromitsu Hirabayashi, Yokohama; Akihiro Nomura, Yokohama; Noribumi Koitabashi, Yokohama, all of Japan

[73] Assignee: Canon Kabushiki Kaisha, Tokyo, Japan

[21] Appl. No.: 931,443

[22] Filed: Aug. 20, 1992

Related U.S. Application Data

[63] Continuation of Ser. No. 722,384, Jun. 26, 1991, abandoned, which is a continuation of Ser. No. 330,822, Mar. 31, 1989, abandoned.

[30] Foreign Application Priority Data

| | | | |
|---|---|---|---|
| Mar. 31, 1988 | [JP] | Japan | 63-76373 |
| Mar. 31, 1988 | [JP] | Japan | 63-76374 |
| Mar. 31, 1988 | [JP] | Japan | 63-76375 |
| Mar. 31, 1988 | [JP] | Japan | 63-76376 |
| Mar. 31, 1988 | [JP] | Japan | 63-76377 |

[51] Int. Cl.[5] ..... B41J 2/165

[52] U.S. Cl. ..... 346/140 R

[58] Field of Search ..... 346/140

[56] References Cited

U.S. PATENT DOCUMENTS

| | | | |
|---|---|---|---|
| 1,848,871 | 3/1932 | Corlett | 361/212 |
| 2,302,065 | 11/1942 | Siegling | 361/212 X |
| 3,336,596 | 8/1967 | Dubbe | 346/135.1 X |
| 4,199,767 | 4/1980 | Campbell | 346/140 X |
| 4,223,322 | 9/1980 | van Raamsdonk . | |
| 4,228,442 | 10/1980 | Krull | 346/140 |
| 4,306,245 | 12/1981 | Kasugayama | 346/140 |
| 4,369,456 | 1/1983 | Cruz-Uribe | 346/140 |
| 4,371,881 | 2/1983 | Bork et al. | 346/140 R |
| 4,376,283 | 3/1983 | Bower | 346/140 |
| 4,432,004 | 2/1984 | Glattli | 346/140 |
| 4,630,075 | 12/1986 | Hori | 346/140 |
| 4,646,111 | 2/1987 | Shimosato | 346/140 |

FOREIGN PATENT DOCUMENTS

| | | |
|---|---|---|
| 41706A3 | 12/1981 | European Pat. Off. . |
| 2705328 | 8/1978 | Fed. Rep. of Germany . |
| 2742963 | 3/1979 | Fed. Rep. of Germany . |
| 2743966 | 4/1979 | Fed. Rep. of Germany . |
| 2756334 | 6/1979 | Fed. Rep. of Germany . |
| 48556 | 3/1987 | Japan . |
| 170350 | 7/1987 | Japan . |

*Primary Examiner*—Joseph W. Hartary

*Attorney, Agent, or Firm*—Fitzpatrick, Cella, Harper & Scinto

[57] ABSTRACT

The present invention relates to a cartridge having a liquid discharger removably mounted onto a main body of a liquid jet recording apparatus. The cartridge comprises a humidifier for humidifying a liquid discharging portion of the liquid discharger, an input member for receiving delivery of an actuating force for actuating the humidifier, an electric contact member for receiving an electric signal actuating the liquid discharger, and a box member for containing the humidifier, input member and electric member.

28 Claims, 17 Drawing Sheets

LIQUID JET RECORDING APPARATUS WITH HUMIDIFYING MEANS

This application is a continuation of application Ser. No. 07/722,384 filed Jun. 26, 1991, now abandoned, which is a continuation of application Ser. No. 07/330,822 filed Mar. 31, 1989, now abandoned.

BACKGROUND OF THE INVENTION

Field of the Invention

The present invention relates to a liquid jet recording apparatus, a cartridge adapted to be detachably mounted on the liquid jet recording apparatus or the like and provided with liquid discharge means, and a band member use for the liquid jet recording apparatus.

Related Background Art

In a liquid discharge recording apparatus or so-called ink jet recording apparatus, in which characters or patterns are recorded by discharging recording liquid from liquid discharge means or a recording head, since said recording liquid (hereinafter called "ink") is directly discharged from discharge openings of the recording head, there is required particular attention, not encountered in other recording apparatuses, in order to maintain the ink constantly in a dischargeable state.

Since the ink remains in the liquid discharge openings of the recording head even in a non-recording state, there is required measures for preventing the drying of ink or deterioration thereof such as a viscosity increase resulting from evaporation in such discharge openings. For this purpose there is already known an apparatus provided with so-called capping means for covering the discharge openings of the recording head in the non-recording state, thereby preventing the drying or evaporation of ink.

However, the increase in ink viscosity can not be avoided by the above-mentioned drying preventing means under a low-humidity condition or after a long pause, and, for this reason there has been employed, in combination with the above-mentioned capping means, a recovery mechanism for sucking the air in the cap covering the recording head thereby applying a negative pressure to the discharge openings for sucking the ink remaining in said openings, or applying a positive pressure for example with a pump to an ink supply system leading to the discharge openings for discharging deteriorated ink from the discharge openings, or effecting preliminary ink discharge from the discharge openings into the capping means thereby eliminating the ink of increased viscosity from the nozzle.

However, such recovery mechanism is generally activated automatically for example at the start of power supply, and is preferably used, during the recording operation, at as long an interval as possible in order to reduce the ink consumption. In order to cope with the deterioration of the ink resulting from a pulse in the use of discharge openings during the recording operation, it is necessary to interrupt the recording operation frequently at short intervals, so that the efficiency of the recording operation is inevitably deteriorated.

Particularly in a liquid discharge recording apparatus utilizing a so-called mutli-orifice recording head in which plural discharge openings are aligned linearly, certain discharge openings are seldom used for recording according to the statistical properties of the data to be recorded, and the interval of discharge becomes very long for such openings. Consequently, the ink in the discharge openings of less frequent discharges, or of long discharge intervals, tends to show an increase in viscosity by evaporation, according to the cirumferential humidity and temperature, thus eventually resulting in unstable ink discharge behavior or in disabled ink discharge.

Consequently, there has recently been proposed an ink jet recording apparatus equipped with humidifying means for maintaining the vicinity of the discharge openings in a humid state, in order to significantly reduce the frequency of the discharge recovery operation by the recovery mechanism and to achieve stable ink discharge without waste of ink.

Such humidifying means is generally designated to apply liquid humidifying agent on a face of the recording head having the ink discharge openings (hereinafter called "discharge opening face"), and is provided, in case of a serial recording apparatus, in a position outside the recording range of the recording head, for example next to said capping means, in such a manner that a member for applying said humidifying agent engages with the discharge opening face at the humidifying operation.

However, such apparatus inevitably requires a complex structure because there are required, for example, means for detecting the remaining or residual amount of the humidifying agent and means for replenishing the same.

The structure becomes even more complex, because the mechanism for activating said humidifying means is not easily compatible with the structure for preventing the evaporation of the humidifying agent.

Furthermore, deterioration of the humidifying means, namely smear or deterioration in performance of the applying member, will result in the smear of the discharge openings, leading to a loss in the recorded image quality.

Furthermore, a complex structure of the humidifying means will increase the possibility of contamination by, for example, dust particles.

On the other hand, when the apparatus is not in use, the discharge opening face is preferably covered with the capping means as explained before, since, otherwise, defective ink discharge or disabled ink discharge may result due to the dust deposition or the increase in ink viscosity. In order to remove the dust particles deposited on the discharge opening face, there is often provided cleaning means.

Consequently, there is generally provided drive means for moving the capping means and the cleaning means, mounted on the main body of the apparatus, relative to the recording head in order to engage these means with said recording head thereby enabling capping or cleaning operation. For example the drive means moves the capping means toward the recording head so it is brought in front of the capping means, or brings the cleaning means in engagement with the discharge opening face.

However, the presence of such drive means, in combination with the presence of the humidifying means, further complicates the structure of the apparatus.

SUMMARY OF THE INVENTION

It is an object of the present invention to provide a liquid jet recording apparatus and a cartridge therefor which can overcome the above disadvantages, and carry out or reliable and stable humidifying process and cleaning and capping with simple construction.

It is another object of the present invention to provide a band member for the liquid jet recording apparatus which can carry out a reliable humidifying process with simple construction, quickly.

It is still another object of the present invention to provide the band member for the liquid jet recording apparatus which can carry out additional functions such as the capping and cleaning quickly and reliably.

It is still another object of the present invention to provide the band member which ca simplify the construction of the liquid jet recording apparatus.

It is still another object of the present invention to provide a cartridge having liquid discharging means and removably mounted onto a main body of a liquid jet recording apparatus. The cartridge comprises humidifying means for humidifying a liquid discharging portion of the liquid discharging means, an import member for receiving deliver of an actuating force for actuating said humidifying means, an electric contact member for receiving an electric single actuating said liquid discharging means, and a box member for containing said humidity means, input means and electric member.

It is still another object of the present invention to provide a band member to be fed in a longitudinal direction thereof with being scrubbed onto a liquid discharging portion of liquid discharging means of a liquid jet recording apparatus. A band member comprising a humidifying function portion for the liquid discharging portion is rendered at a side of the band member opposing to liquid discharging means.

DESCRIPTION OF THE PREFERRED EMBODIMENTS

Now, the present invention will be clarified in detail by embodiments thereof shown in the attached drawings.

Embodiment 1

Figure 1:
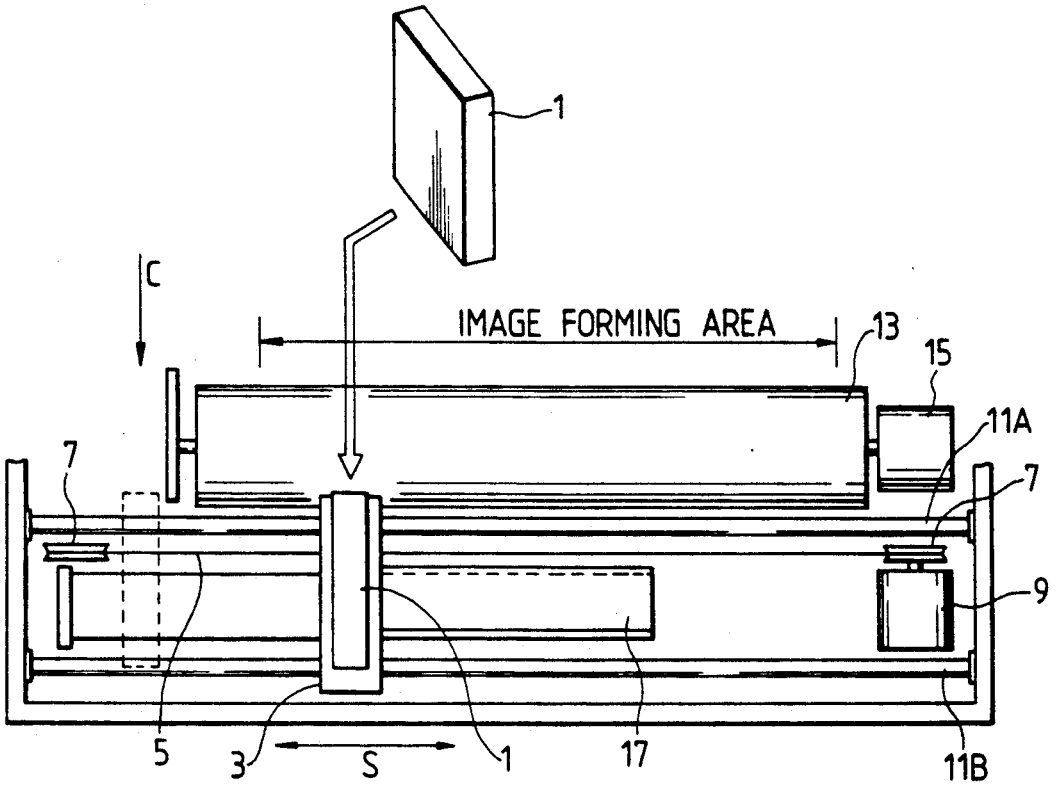
FIG. 1 is a plan view showing an example of an ink jet recording apparatus according to the present invention.

FIG. 1 shows an ink jet recording apparatus employing ink as the recording liquid, constituting an embodiment of the present invention.

There are shown a cartridge 1 provided with a recording head and detachably mounted on the main body, as will be explained later; a carriage 3 detachably supporting said cartridge 1 and driven in a direction S; a wire 5 fixed to said carriage 3 and supported between pulleys 7 provided on both ends of the movable range; a motor 9 linked with one of said pulleys 7 and serving to move the carriage 3 in the direction S; and first and second guide rails 11A and 11B extended in the direction S for guiding the carriage 3.

There are further shown a platen roller 13 for advancing a recording medium such as paper or film and defining the recording surface thereof; a motor 15 linked with said platen roller 13 and serving to rotate said platen roller 13 for advancing the recording medium; and a control signal cable 17 connected between the carriage 3 and control means (not shown) for transmitting image data and control signals between said control means and the cartridge 1, and composed of a flexible cable capable of following the movement of the carriage 3.

In the above-explained structure, the cartridge 1 can be replaced at a suitable position C of the carriage 3, for example at a home position outside the image recording range. When the cartridge 1 is mounted on the carriage 3, electrical contacts provided on the cartridge 1 are connected to contact members on the carriage 3, whereby the recording head etc. and the control means are electrically connected to enable a recording operation.

In the recording operation, the carriage 3 is set in a scanning motion in the direction S by the motor 9, and the recording head is activated in the course of said movement to discharge ink toward the recording medium supported by the platen roller 13, thereby executing the recording operation. After the recording of one line, the recording medium is advanced a predetermined amount by the motor 15.

Figure 2:
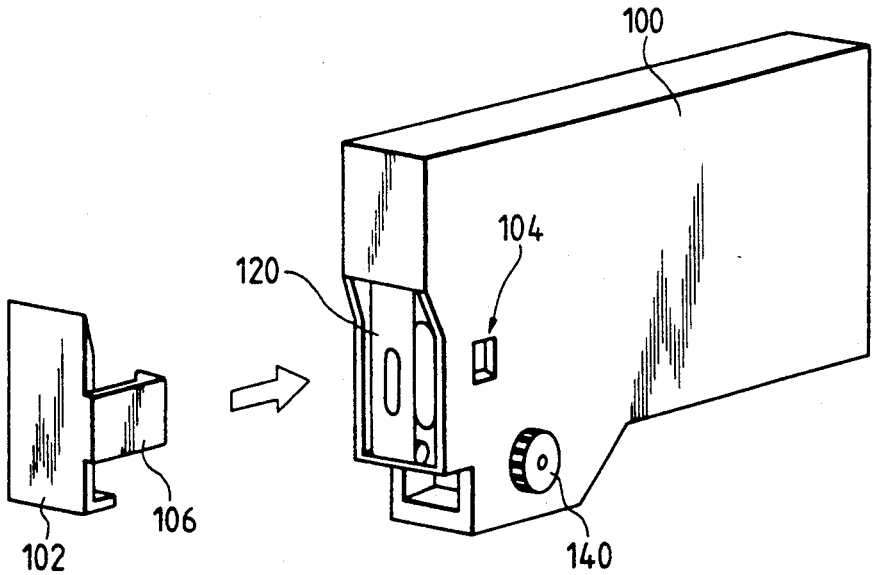
FIG. 2 is a perspective view an example of a cartridge according to the present invention in which a tape is used as humidifying means.
Figure 3:
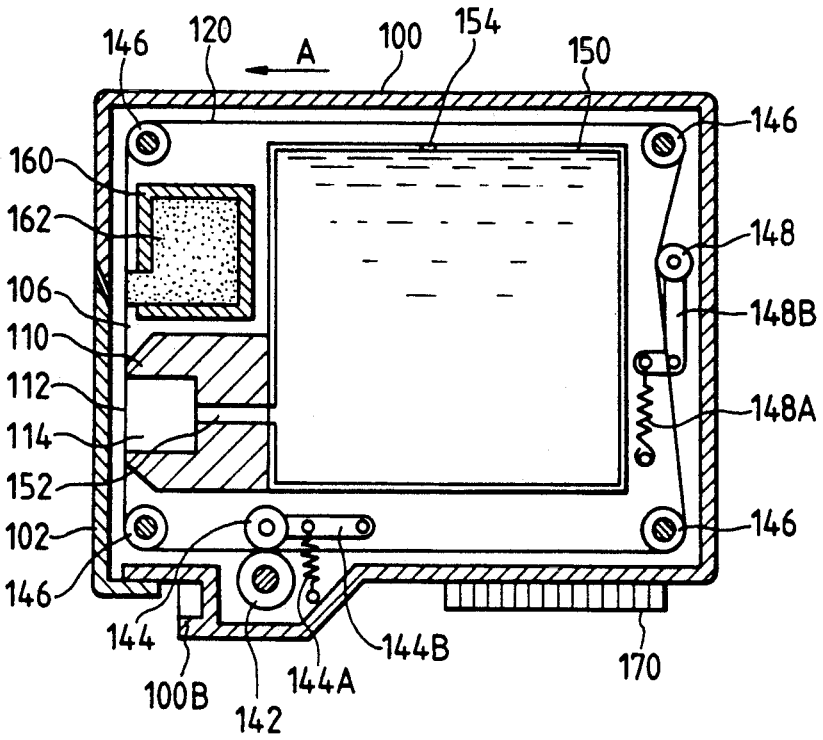
FIG. 3 is a cross section of the same.

FIG. 2 is a perspective view showing an example of the external structure of the cartridge 1, and FIG. 3 is a cross-sectional view showing an example of the internal structure thereof.

Referring to FIG. 2, there is shown a casing 100 incorporating following components; a protective cover 102 detachably mountable on the casing 100; an engaging groove 104 provided on the casing 100; and an engaging member 106 provided on the protective cover 102 and serving to engage with the groove 104. The protective cover 102 is mounted on the casing 100 by the engagement of said groove and said engaging member. When the cartridge 1 is in use, the protective cover 102 is detached to expose a face (discharge opening face) 112 in which at least discharge openings of the recording head 110 are provided, whereby said face can be brought into facing relationship with the recording medium. On the other hand, when the cartridge 1 is still unused or detached, the protective cover 102 is mounted on the casing 100 to protect the recording head 110 etc. in the cartridge 1.

There is also provided a tape member 120 (tape) having an aperture 122 for exposing the discharge opening face 112 of the recording head 110. The structure of said tape 120 will be explained later with reference to FIGS. 6 and 7. A gear 140 is provided outside the casing 100 for transmitting the driving force to said tape 120.

Then, referring to FIG. 3, there are shown a driving roller 142 coaxial with the gear 140; a pinch roller 144 for pressing the tape 120 against the driving roller 142, provided on an end of a roller arm 144B biased in rotation toward the driving roller 142 by means of a spring 144A; rollers 146 for defining the path of the tape 120 formed as an endless belt in the present embodiment; and a tension roller 148 provided for applying tension to the tape 120 and positioned on an end of a tension arm 14BB biased in rotation toward the tape 120 by means of a spring 148A. Said tension roller 148 ensures that the tape 120 runs along the transport path thereof and is in sliding contact with the discharge opening face 112.

A reservoir member (ink tank) 150 for storing the recording liquid or ink constitutes a main ink supply source for the recording head 110 in the present embodiment, and supplies a chip 114 of the recording head 110 with ink through a liquid path 152. An opening 154 provided on the upper face of the ink tank 150 serves to introduce air according to the ink consumption in the ink tank 150. Said ink tank 150 need not necessarily be provided in the cartridge 1. For example, the ink may by supplied to the recording head 110 for example through a tube from an ink supply source fixed in the main body of the apparatus. In such case, a sub ink tank may be provided in the cartridge.

Figure 12:
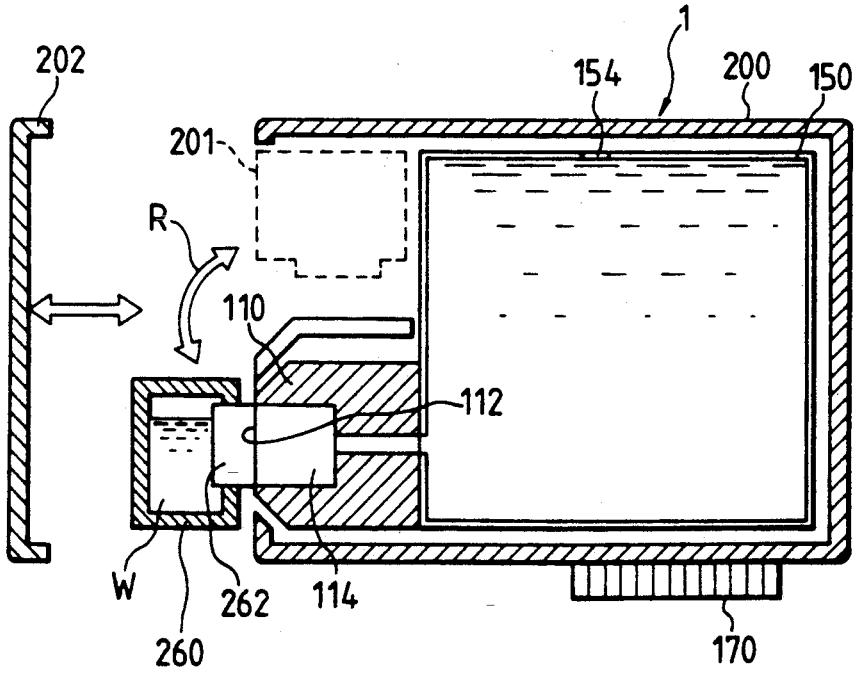
FIG. 12 is a cross section showing another embodiment of humidifying means provided on the cartridge.

A humidifying agent chamber 160 contains an impregnating member 162 composed for example of an absorbent material impregnated with humidifying agent, and is so constructed as to engage said impregnating member 162 with the rear surface of the tape 120 (in sliding contact with the discharge opening face 112) for applying the humidifying agent thereon. Thus, by the movement of the tape 120 in a direction A, the rear surface, coated with the humidifying agent, of the tape 120 reaches the discharge opening face 112 to apply said humidifying agent thereto. It is also possible to form the humidifying agent chamber in the form of a tank storing the liquid humidifying agent, provided therein with a humidifying material having a portion dipped in said humidifying agent and a portion engaging with the tape 120 (FIG. 12).

An electrical contact member 170 formed as a connector may be provided with contacts for receiving image signals, drive signals and other contact signals, and contacts for transmitting state signals of the cartridge 1, such as an ink amount detection signal. The chip 112 is provided with an array of plural ink discharge openings, and energy generating elements, corresponding respectively to said openings, for applying discharge energy to the ink in response to drive signals. Said energy generating element can be composed, for example, of an electro-thermal converter for generating heat in response to electric current supply, thereby generating bubbles in the ink and causing ink discharge. A detection aperture 100A is provided in the casing 100 as will be explained later. An aperture 106 is provided on the casing 100 for communication of the interior thereof with the exterior, and, at the recording operation, the interior of the ink tank 150 communicates with the external air through the apertures 106 and 154. A lower profile of the casing 100 below the recording head 110 constitutes a positioning portion 100B for the carriage 3.

Figure 4:
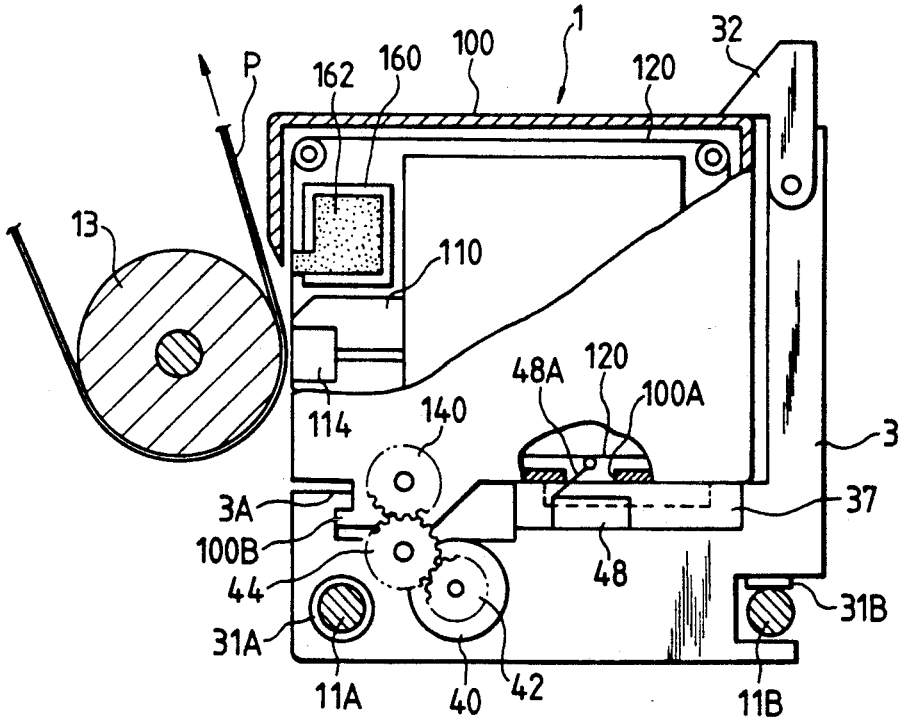
FIG. 4 is a front view (partially broken) showing a state in which the cartridge of FIGS. 2 and 3 is mounted on the recording apparatus of FIG. 1.
Figure 5:
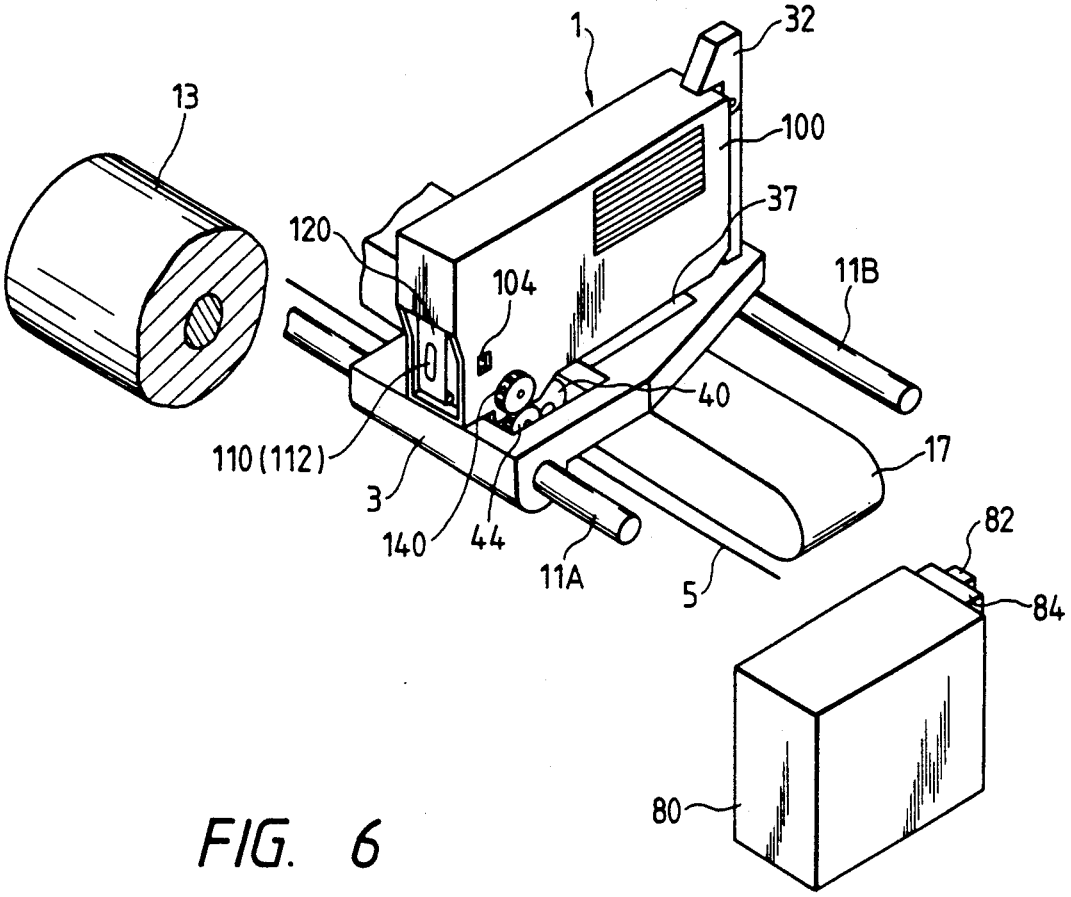
FIG. 5 is a perspective view of the same.

FIGS. 4 and 5 show a state in which the cartridge 1 is mounted on the carriage 3 to enable the recording operation.

In these figures, there are shown bearings 31A, 31B respectively for the first and second guide rails 11A, 11B; a locking arm 32 provided on the carriage 3 for fixing the cartridge 1; and an electrical contact member 37 for receiving the electrical contact member 170 of the cartridge 170 for connection to the cable 17.

There are further shown a humidifying motor 40 provided on the carriage 3 and serving to drive the tape 120 at the humidifying operation; a motor gear 42 fixed on the shaft of said motor 40; and a drive gear 44 meshing with the gear 42 and with the gear 140 in the illustrated mounted state of the cartridge, thereby transmitting the rotation of the motor 40 to said gear 140. Naturally, the above-explained transmission mechanism may be constructed in an arbitrary manner.

Referring to FIG. 4, a microswitch 48 provided on the carriage 3 has an actuator 48A which is in contact with the tape 120 through the detection aperture 100A of the casing 100. In the mounted state of the cartridge 1, said microswitch 48 is turned off when the aperture 122 of the tape 120 reaches the actuator 48A, and the motor is so controlled from the turn-off time as to bring the aperture 122 of the tape 120 to the discharge opening face 112 thereby enabling a recording operation. Said switch 48 may also be used as a sensor for detecting the presence of the mounted cartridge 1. For such purpose, there may be employed any sensor, instead of the microswitch 48. For example, there may be employed a transmissive photosensor of which paired components are respectively provided in the cartridge 1 and the carriage 3, or a reflective photosensor provided on either of the two. Also there may be employed a reflective photosensor provided, in a predetermined position of the image area (cf. FIG. 1) so as to face the discharge opening face 112. In the use of such reflective photosensor, the front surface of the tape 120 is made reflective to light. In a position of the carriage 3 close to the platen roller 13, there is provided a positioning portion 3A to engage with the positioning portion 100B of the cartridge 3, thereby defining the position of the cartridge with respect to the carriage 3.

Referring to FIG. 5, a recovery unit 80 is provided in a predetermined position outside the recording range of the recording head 110, for example in the home position, so as to oppose the discharge opening face 112 of the head 110, and to be moved relative thereto at the discharge recovery operation of the head 110. There are shown a capping member 82, composed for example of rubber, for covering the discharge opening face 112 as the result of said relative movement, and a holder 84 therefor.

The discharge recovery operation can be achieved by ink discharge (preliminary discharge) by the normal driving of the recording head 110, or by ink suction from the head 110 by means of a pump provided in the recovery unit 80, thereby removing viscosified ink, bubbles, dusts etc. from the recording head 110. Also if the ink is supplied, not from the ink tank 150 provided in the cartridge 1 as in the present embodiment, but from an ink supply system in the main body of the apparatus, the ink discharge may be achieved by pressurizing said ink supply system.

The recovery unit 80 may be used for protecting the recording head 110 by the engagement therewith during the pause of the recording operation.

Figure 6:
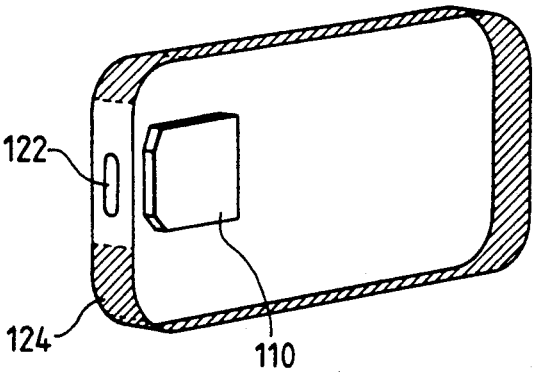
FIGS. 6 and 7 are explanatory drawings showing construction of the tape used in the present embodiment.

FIG. 6 illustrates the structure of the tape 120 in the present embodiment.

The tape 120 for transferring the humidifying agent from the impregnating material 162 to the discharge opening face 112 of the recording head 110, is provided with the aperture 122 for enabling ink discharge at the recording operation. Said aperture 122 is so sized as to expose the aperture 106 of the casing. The humidifying function may be conducted by the entire rear surface of the tape 120 excluding the aperture 120, or by a hatched portion 124 thereof.

In the following there will be explained the humidifying means of the present embodiment, namely the tape 120, humidifying agent and impregnating member.

At first there will be explained the material of the tape 120.

The tape 120 is required to satisfy following requirements:

(i) high tensile strength; and
(ii) high flexibility, in order to improve adhesion to the discharge opening face 112 of the recording head 110, thereby achieving complete humidification;
(iii) satisfactory sliding ability, for maintaining sliding contact with the discharge opening face 112; and
(iv) easy surface modification or easy formation of other substance thereon, in order to achieve satisfactory transfer of the humidifying agent.

In consideration of the foregoing, the tape 120 can be composed of a polymer film for example of polyethylene terephthalate (PET), polyimide (PI), polytetrafluoroethylene-perfluoroacrylvinyl ether copolymer (PFA) or polyvinyl alcohol (PVA), reinforced paper or a thin metal foil such as of aluminum.

Figure 7:
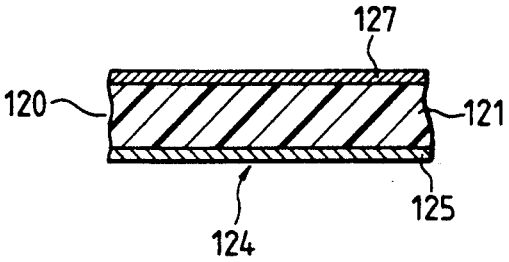

FIG. 7 shows an example of the structure of the tape 120, composed of a substrate (base) 121 and a humidifying layer 125 provided thereon as a humidifying part 124. On the front surface of the tape 120 there is formed an antistatic layer 127, for preventing the deposition of dust particles by an electrostatic charge, and said layer can be formed by metal evaporation or by mixing of conductive fine particles such as carbon.

The humidifying part 124 on the front surface (coming into contact with the impregnating member 162 and the discharge opening face 112 in the present embodiment) of the tape 120 is preferably wettable with the humidifying agent and adapted to maintain such an state for a certain period, and, for this reason, the absorbing property is advantageously improved by forming a porous or irregular surface. This is achieved, for example, by:

(i) forming fine surface irregularities thereby realizing the humidifying part of an absorbing nature;
(ii) forming fine surface irregularities by mixing fine particles in the resin used in film molding or by ultraviolet irradiation, and supporting the humidifying agent by said irregularities;
(iii) coating the surface with a moisture-absorbing and foaming material, such as PVA, to form the humidifying part; or
(iv) adhering or laminating a surface material with humidifying function on the above-mentioned tape substrate thereby forming the humidifying part.

The member 162 can be composed of a spongy porous material for achieving uniform application of the humidifying agent on the surface of the tape 120.

For example it can be composed of a polymer material, such as polyurethane polyvinyl alcohol, foamed with a high density, or felt composed of wool or other fibers.

The humidifying agent preferably satisfies the following requirements, in order to effectively humidify the discharge opening face 112 thereby preventing the blocking of the openings:

(i) to have affinity to water and to be stable in aqueous solution;
(ii) to be capable of retaining moisture;
(iii) to be of a low viscosity (for example 1–10 cp, or 1–100 cp) and a high surface tension (for example 400 dyn/cm or higher);
(iv) to have a high dissolving power for the dyes of the ink;
(v) to be free from odor and to be harmless; and
(vi) not to freeze at low temperature.

These requirements are satisfied by glycols, glycolethers, amides or pyrrolidones, or mixtures thereof with water, or mixtures of these substances. Other materials can also be utilized depending on the purpose, for example for reducing the viscosity of the viscosified ink. For example clear ink, water or alcohol may be used for such purpose, though these materials do not satisfy all the requirements.

Figure 8:
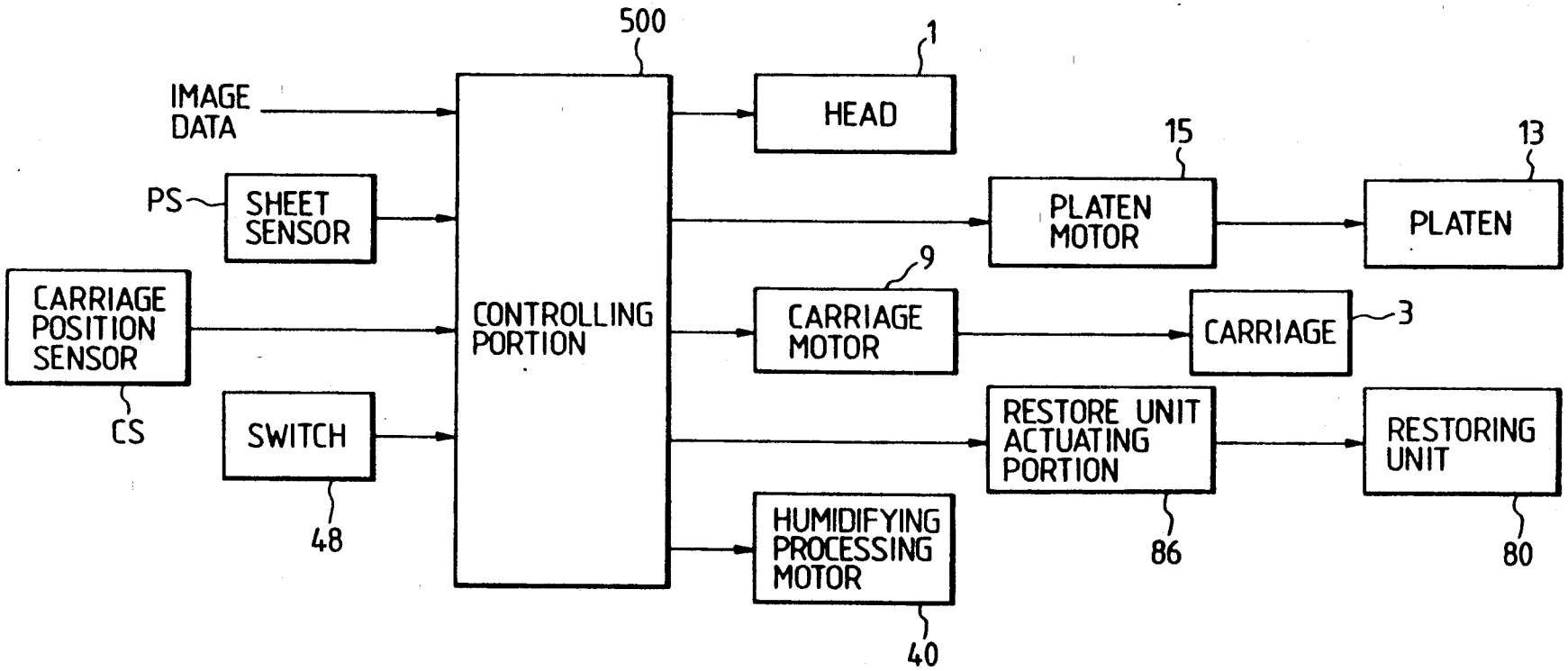
FIG. 8 is a block diagram showing a construction of a controlling system in the present embodiment.

FIG. 8 shows an example of a humidifying operation control unit of the present embodiment, constructed as a part of the control system of the recording apparatus.

A control unit 500, composed of a micro-computer provided for example with CPU, ROM, RAM etc., controls various units according to a control program stored in the ROM, and controls the recording and other operations by driving a head 1 according to the image data received for example from a host apparatus. The control unit 500 also drives the platen driving motor 15 thereby controlling the advancement of the recording medium, in response to the detection by a sensor PS for detecting said recording medium P. If further controls the motion of the carriage 3 and the movement thereof to the home position through the carriage motor 9, in response to the carriage position information detected by a carriage position sensor CS.

If further activates the recovery unit 80 through a recovery unit drive circuit 86, thereby effecting the capping on the recording head 110 and the discharge recovery thereof. Furthermore it controls the motor 40 for tape transportation, thereby effecting the movement of the tape 120 for the humidifying operation and the positioning of the aperture 122 according to the state of the switch 48.

Figure 9:
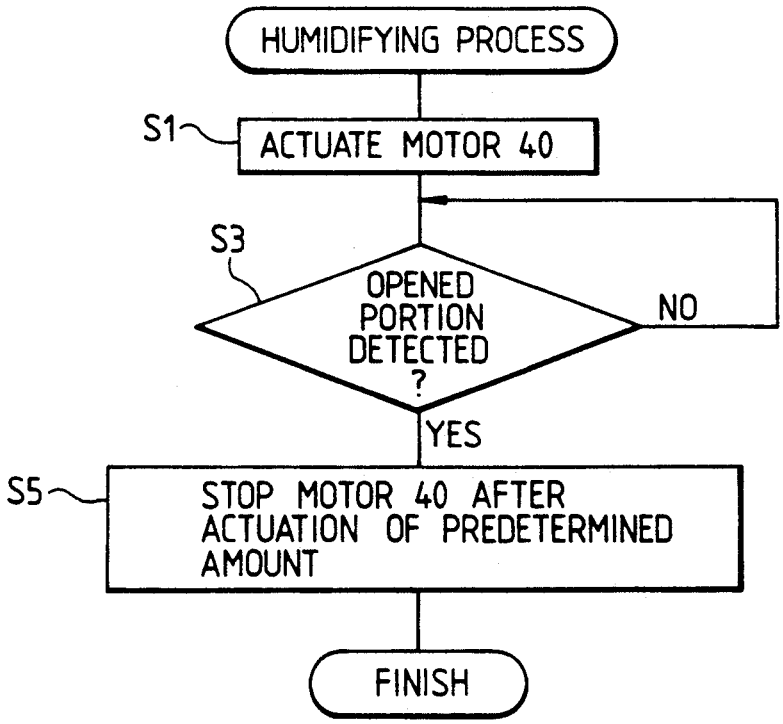
FIG. 9 is a flow-chart showing a routine or sequence of a humidifying process according to the present embodiment.

FIG. 9 shows an example of the humidifying routine or sequence in the present embodiment.

When this routine is activated, a step S1 activates the motor 40, thereby transporting the tape 120 in the direction A shown in FIG. 3. Thus, the humidifying agent is given from the impregnating member 162 to the humidifying part 124 (humidifying layer 125) of the tape 120, and is applied onto the discharge opening face 112 when said tape arrives thereat.

Then a step S3 discriminates whether the aperture 122 has passed the position of the switch 48, based on the signal therefrom. If the result of said discrimination is affirmative, the motor 40 is driven corresponding to the known length of the tape 120 (with continued application of the humidifying agent on the discharge opening face 112), and the motor 40 is stopped when the aperture 122 reaches the position of the discharge opening face 112 (step S5).

The amount of movement of the tape 120 from the start to the stopping of the motor 40, namely the number of rotations of the endless tape 120 can be one turn or several turns as long as proper humidifying can be obtained. It can be less than one turn if the tape 120 is provided with plural apertures 122.

The above-mentioned routine can be activated at any suitable timing. For example it can be conducted at the start of power supply, at the start of recording operation, after the discharge recovery operation, after the lapse of a predetermined period, or after the recording operation of a predetermined amount. Also the carriage need not be outside the image recording range, since there is no member protruding toward the platen roller 13, so that said routine may be executed during the returning motion of the carriage 3, or by interrupting the recording operation and without moving the recording head.

In the above-explained embodiment, the discharge opening face 112 is maintained a humidified state during the recording operation by the humidifying means including the tape 120 and the impregnating member 162, so that the area in the vicinity of the discharge openings is protected from drying. Thus the failure in ink discharge resulting from increase in viscosity can be suppressed even if the frequency of ink discharges or recovery operation is reduced. It is therefore rendered possible to accordingly increase the recording speed, and to reduce the unnecessary waste of ink.

Also, since the recording head 110 and the humidifying means are integrated in a cartridge, the service life of the humidifying means can be designed corresponding to that of the recording head 110. Thus, a high recording image quality can be maintained for a long time, since the humidifying agent and the tape 120 are replaced simultaneously with the replacement of the recording head 110.

Besides, since the humidifying means can be positioned spatially close to the discharge opening face 112, the probability of contamination by dust particles at the humidifying operation is reduced, whereby the reliability is improved, and the response of the humidifying operation is also improved.

In addition the humidifying operation can be conducted in the cartridge alone, scarcely depending on the structure of the main body of the recording apparatus. Also the timing of said operation is scarcely restricted, and the pause required in the main body is also reduced.

Furthermore, the above-explained embodiment can simplify the structure and the operation, since the impregnated member 162 is positioned at the same side of the discharge opening face 112 with respect to the tape 120 and does not hinder the recording operation.

Furthermore, since the humidifying agent is applied by sliding contact of the tape 120 with the discharge opening face 112, there can also be prevented the retraction of meniscus of the ink in the discharge openings or the air inhaling therein. Also the use of thin tape 120 permits a compact allows to compactize the cartridge 1 and facilitates the humidifying operation in the image recording range, and the flexibility of said tape realizes intimate contact thereof with the discharge opening face 112, thus achieving an improved humidifying operation.

Furthermore, if the humidifying agent chamber 160 is not filled with the impregnating member 162 but is constructed as a tank containing a liquid humidifying agent, it is suitably agitated by the acceleration. This is desirable since the effect of homogenization by agitation is large while the disadvantage of foaming is limited.

However, the structure humidifying of the agent applied on the discharge opening face 112 with a tape-formed member is not limited to the foregoing embodiment.

Figure 10:
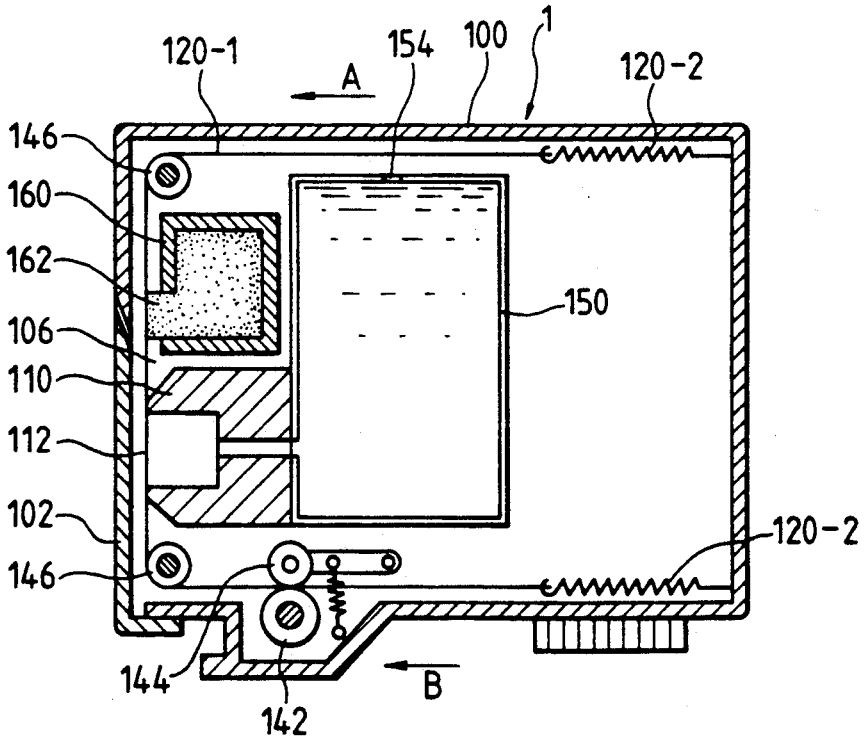
FIGS. 10 and 11 are cross sections respectively showing another embodiment of the cartridge using the tape as humidifying means.

For example, as shown in FIG. 10, the tape is not formed as an endless belt but is supported, as indicated by 120-1, on both ends with elastic members 120-2 such as springs. In such case the contact of the tape 120-1 with the discharge opening face 112 is ensured by the tension of the elastic members 120-2. The tape 120-1 is moved in a direction A at the humidifying operation, and in a direction B after said operation, thereby achieving the application of the humidifying agent and the positioning of the aperture.

It is furthermore possible to effect the humidifying operation on the discharge opening face 112 of the recording head 110 without the humidifying agent chamber.

Figure 11:
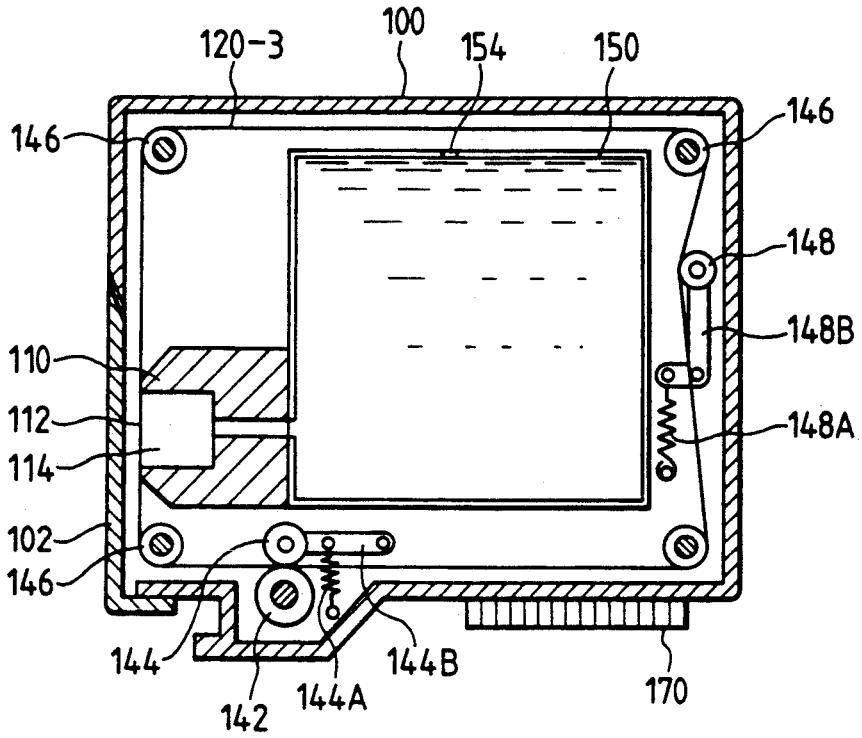

FIG. 11 illustrates such embodiment, employing a tape 120-3 of which humidifying part (cf. FIGS. 6 and 7) is impregnated in advance with the humidifying agent. Instead of such impregnation in advance, it is also possible to receive the ink in the humidifying part from the recording head 110 and to utilize said ink as the humidifying agent. In such case, it is preferable to absorb the dye components of the ink into the tape, and to utilize only the water retained on the tape surface. The ink is principally composed of dyes or pigments serving as the coloring agent, and liquid medium for dissolving or dispersing said dyes or pigments, and contains various additives. The coloring agent is generally composed of water-soluble dyes such as direct dyes or acid dyes, and the liquid medium is composed of water or the components described above with respect to the humidifying agent.

In the foregoing embodiments, the running path of the tape and direction of movement thereof are not critical as long as the discharge opening face 112 can be effectively humidified. The tape in the foregoing embodiments is moved in the vertical plane, but it may be moved in the horizontal plane.

In the foregoing, there have been explained structures employing a tape member for the application of humidifying agent. In the following there will be explained embodiments of the humidifying means not utilizing such tape.

FIG. 12 illustrates the carriage 1 constituting another embodiment of the present invention, wherein the same components as those in the foregoing embodiments are represented by the same numbers.

Referring to FIG. 12, a casing 200 of the cartridge 1 of the present embodiment is provided with a chamber 201 capable of accommodating a humidifying agent chamber 260. A protective cover 202, similar to the aforementioned protective cover 102, is so shaped as to cover the front face of the recording head 110 including the discharge opening face 112 and the chamber 201.

The humidifying agent chamber 260 stores liquid humidifying agent W and is provided with a containing member 262 impregnated with said humidifying agent, said member being brought into contact with the discharge opening face 112 at the humidifying operation to effect the application of the humidifying agent. After the humidifying operation, the humidifying agent chamber 260 is rotated as indicated by an arrow and is contained in the chamber 201. Thus the recording operation is not hindered. The humidifying agent chamber 260 may be filled with the containing member as explained before (cf. FIG. 3).

Figure 13A:
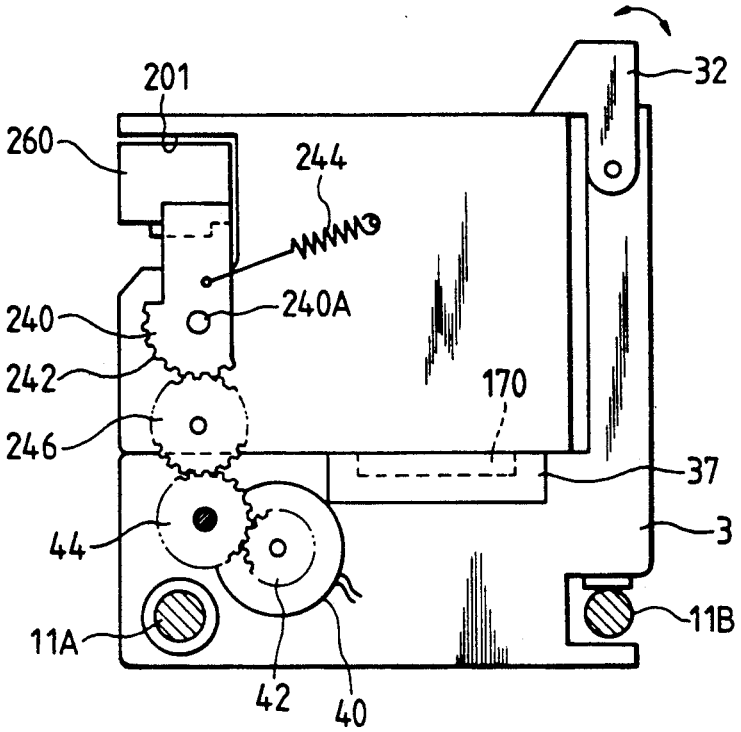
FIGS. 13A and 13B are side views showing the construction and operation of the mechanism operating humidifying means of FIG. 12.
Figure 13B:
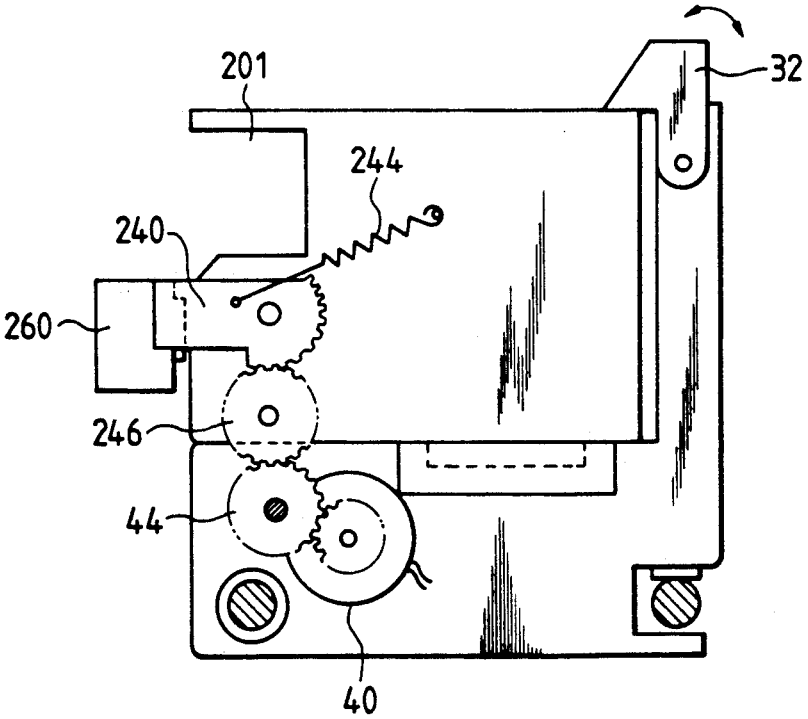

FIGS. 13A and 13B illustrate examples of the mechanism for moving the humidifying agent chamber 260.

In these figures there are shown a driving arm 240 supporting the humidifying agent chamber 260 and biased by a spring 244 clockwise about a shaft 240A, in a direction to accommodate the humidifying agent chamber 260 in the chamber 201; and a gear 242 provided on the driving arm 240 and coupled with the driving gear 44 of the carriage 3 through an intermediate gear 246.

In such apparatus, the motor 40 is rotated in the forward direction for effecting the humidifying operation. In response the driving arm 240 rotates anticlockwise against the biasing force of the spring 244, whereby the containing member 262 of the humidifying agent chamber 260 is brought into contact with the discharge opening face 112 as shown in FIG. 13B whereby the humidifying agent is applied onto said face 112. In the present embodiment, the abovementioned operation can be conducted at a carriage position outside the image recording range.

After said operation, the motor 40 is reversed to return the humidifying agent chamber 260 to the position shown in FIG. 13A. The recording or capping operation is not hindered by placing said chamber in the position shown in FIG. 13A, and such state is secured by the spring 244.

Figure 14:
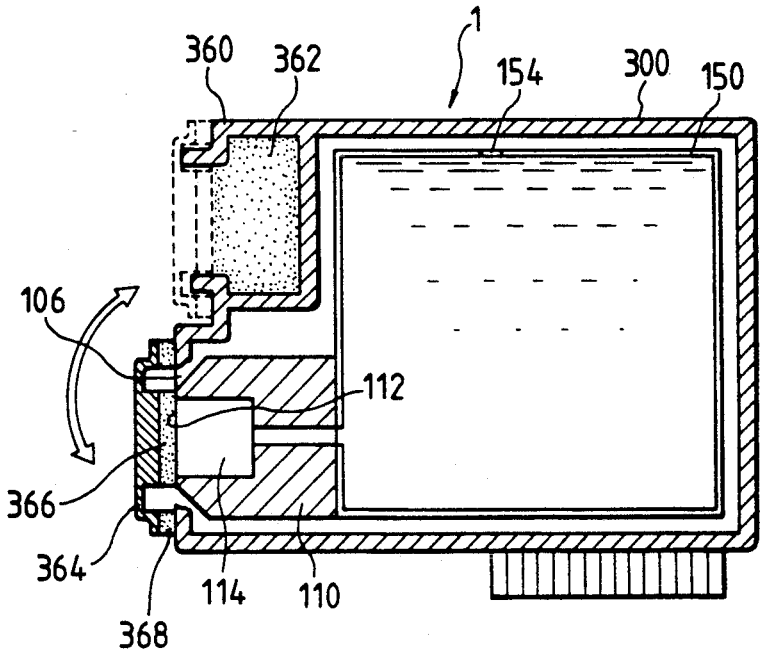
FIG. 14 is a cross section showing still another embodiment of humidifying means provided on the cartridge.

FIG. 14 shows still another embodiment of the cartridge 1 of the present invention, in which, instead of the movement of the humidifying agent chamber as shown in FIG. 12, there is provided a rocking member for receiving the humidifying agent from a fixed humidifying agent chamber and being moved to apply said humidifying agent to the discharge opening face 112.

Referring to FIG. 14, there are shown a casing 300; a humidifying agent chamber 360 fixed to the casing 300; a containing member 362 impregnated with the humidifying agent; a cap 364 capable of rocking between a solid-lined position in contact with the discharge opening face 112 and a broken-lined position in contact with the containing member 362 and provided with humidifying agent containing material 366 for effecting said contact; and a closing member 368 provided on the cap 364. The presence of said closing member allows use of the cap 364 as a protective member for the recording head 110 when it is not in the recording operation, or as a protective member for preventing the humidifying agent chamber 360 from dust particles and drying.

Figure 15:
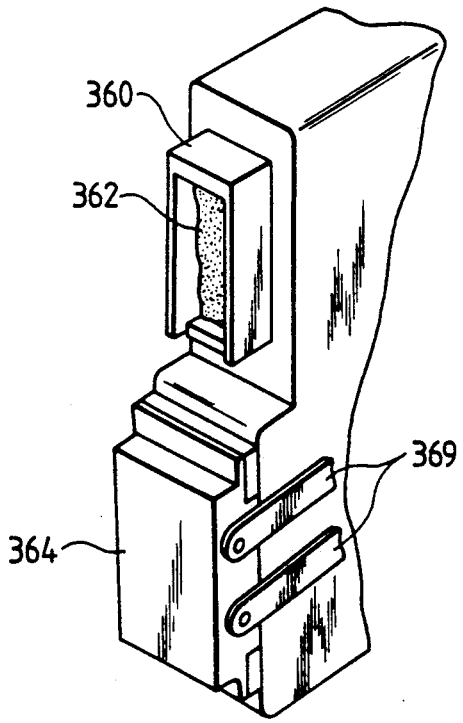
FIG. 15 is a perspective view showing the mechanism for operating the humidifying means of FIG. 14.

FIG. 15 shows an example of the moving mechanism for the cap 364, wherein said cap 364 is supported by rocking arms 369 to enable the above-mentioned rocking motion. Said rocking arms can be driven by a transmission mechanism as shown in FIGS. 13A and 13B.

Also in the embodiments shown in FIGS. 12 and 14, the humidifying operation is possible with a control system as shown in FIG. 8. The control sequence consists of driving the motor 40 at the humidifying operation to bring the containing material 262 or 366 into contact with the discharge opening face 112, maintaining this state until the humidifying agent is sufficiently absorbed, and then reversing the motor 40 to return the humidifying agent chamber 260 or the cap 364 to the broken-lined position shown in FIG. 12 or 14. In these embodiments, since the humidifying means has to be positioned in front of the front face of the cartridge 1, the above-explained operation should be conducted at a position where the cartridge does not face the platen roller 13, in order to prevent collision with the platen roller 13 or the recording medium.

These embodiments also provide the advantages of a humidifying operation, of integrating the humidifying means with the recording head, and of positioning the two in close vicinity, as in the foregoing embodiments. In addition, since the timing of the humidifying operation can be suitably selected, it is easily possible to continuously conduct the humidifying operation and to effectively increase the effect of the humidifying operation.

The above-explained humidifying means not only performs the humidifying function, but also a capping function in a structure as shown in FIG. 14 and a cleaning function for the liquid discharge portion in case of a tape in sliding contact with the recording head as shown in FIG. 12.

The present invention is not limited to the foregoing embodiments but it is possible to arbitrarily select the structure of the recording head and the humidifying means, mode of humidifying agent application, and the mechanism therefore, as long as the recording head and the humidifying means are integrated.

For example, in an embodiment employing a tape as the humidifying means, the application of the humidifying agent to the humidifying part may be achieved for example by passing the tape, in the moving path thereof, in a reservoir containing the humidifying agent, or by employing a roller or rollers impregnated with the humidifying agent at least as a part of the transport rollers 146, or employing a roller or rollers for picking up the humidifying agent from a suitable reservoir for the humidifying agent, at least as a part of the transport rollers. It is furthermore possible to use the tape only one time, by employing a tape with a feeding side and a take-up side. In such case the tape at the feeding side may be immersed in a reservoir for the humidifying agent. The presence of such reservoir also provides an advantage that the interior of the cartridge 1 is maintained at a suitable vapor pressure.

Embodiment 2

In the present embodiment, the entire structure of the ink jet recording apparatus is the same as shown in FIG. 1.

Figure 16:
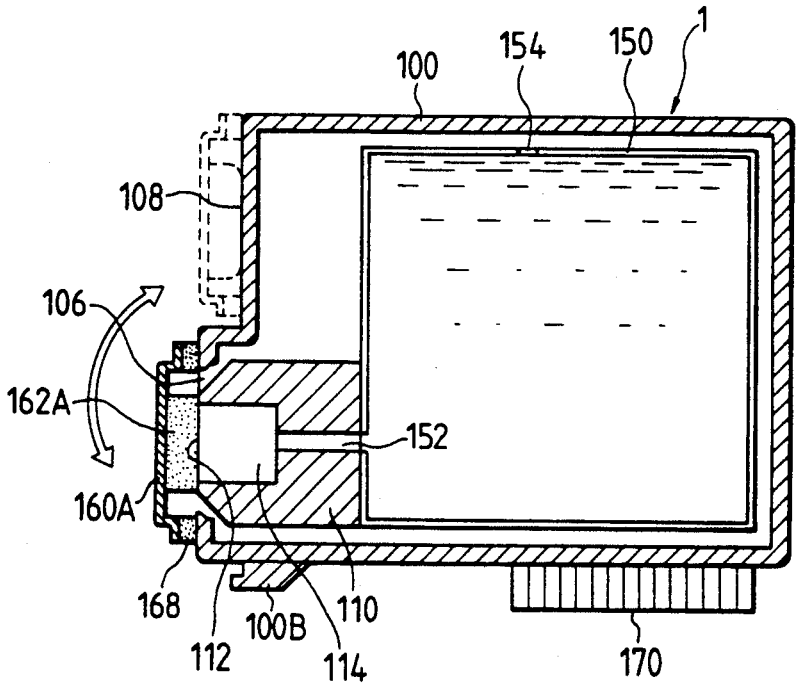
FIG. 16 is a cross section showing still another embodiment of the cartridge.

FIG. 16 is a cross-sectional view showing an embodiment of the internal structure of the cartridge 1, in which there is shown a casing 100 incorporating the following components; an ink tank 150 storing recording ink and constituting a main supply source of the ink to the chip 114 of the recording head 110 through a liquid path 152; and an aperture 154 provided on the upper face of the ink tank 150 for introducing air according to the consumption of the ink in the ink tank 150. Said ink tank 150 need not necessarily be provided on the tank 1, but the ink may be supplied to the recording head 110 from an ink source, fixed in the main body of the apparatus, for example through a tube. In such case, the ink tank may be utilized as a subsidiary tank.

A cap 160A may be moved between a stored position (broken-lined) and a capping position (solid-lined) for capping the discharge opening face 112 and an aperture 106 of the casing. A containing member 162A, impregnated with humidifying agent, is brought into contact, at said capping position, with the discharge opening face 112 of the recording head 110 thereby applying the humidifying agent thereto. A closing member 168, provided on the cap 168A and serving to close the interior of the cap 160A from the exterior in the stored and capping positions, is used for protecting the containing member 162A from drying and dust particles in the stored position, and the recording head 110 and the ink tank 150 at the capping position. Since the recording operation is conducted while the cap 160A is in the stored position, the casing 160 is provided with a suitable storing portion 108 in order that the cap 160A does not protrude from a plane of the discharge opening face 112 toward the platen roller 13.

Also the containing member 162A in the cap 160A may be replaced by a tank storing liquid humidifying agent and a containing member having a portion immersed therein and another portion to be in contact with the discharge opening face 112.

An electrical contact member 170 formed as a connector is provided with contacts for receiving image signals, drive signals and other control signals, and other contacts for transmitting state signals of the cartridge 1, such as an ink amount detection signal. The chip 112 is provided with an array of plural ink discharge openings, and with energy generating elements respectively corresponding to said discharge openings and applying discharging energy to the ink in response to drive signals. Said energy generating elements may be composed, for example, of electrothermal converters for generating heat in response to electrical current supply, thereby generating bubbles in the ink and thus discharging the ink. An aperture 106 is provided on the casing 100, and, in the recording operation, the interior of the ink tank 150 communicates with the external air through said aperture and the aperture 154. A bottom profile of the casing 100 below the recording head 110 constitutes a positioning portion 100B for the carriage 3.

The material and properties of the containing member and the humidifying agent employed in the present embodiment may be the same as those in embodiment 1.

Figure 17A:
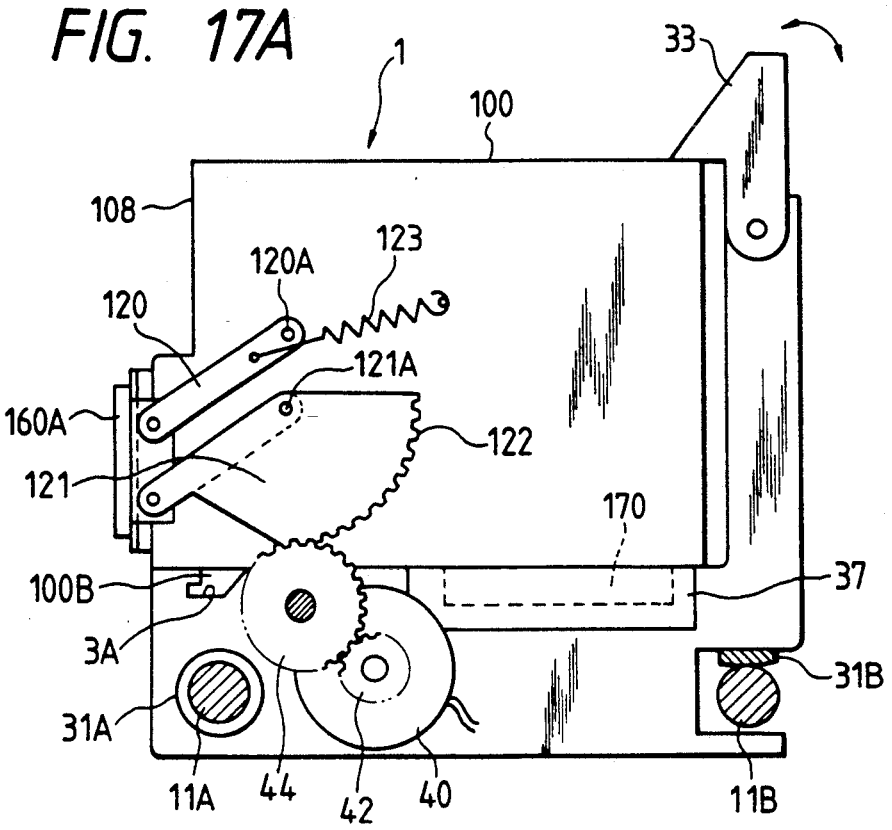
FIGS. 17A shows construction of the mechanism for actuating capping means of the cartridge of FIG. 16.
Figure 17B:
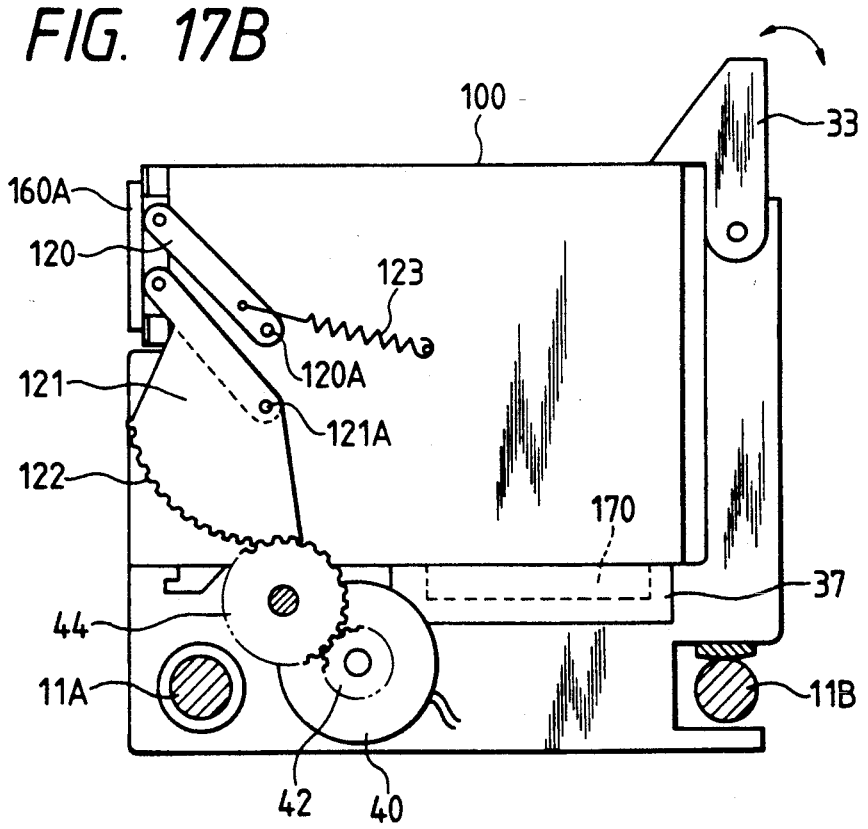
FIG. 17B is a side view for explaining the operation of the same.

FIGS. 17A and 17B illustrate the external view of the cartridge 1 in a state mounted on the carriage 3, respectively in the stored state and in the capping state of the cap.

A positioning part 3A is provided on the carriage 3 close to the side thereof facing the platen roller 13, for engaging with the positioning portion 100B of the cartridge 1 thereby defining the position thereof with respect to the carriage 3.

There are also shown bearings 31A, 31B respectively for the first and second guide rails 11A, 11B; a locking arm 33 for fixing the cartridge 1' and an electrical contact member 37 for accepting the electrical contact member 170 of the cartridge 1 for connection with the cable 17.

There are further shown a motor 40 provided on the carriage 3 for driving the cap 160; a motor gear 42 fixed on the shaft of said motor 42; and a driving gear 44 meshing with the gear 42.

Rocking arms 120, 121 support the cap 160 at the ends thereof and are articulated at the other ends on the casing 100 by means of pins 120A, 121A, thus forming a parallel link mechanism. A spring 123 is provided between a rocking arm 120 and the casing 100, thereby biasing said arm and securing said arms either in the capping position or in the stored position. Naturally, the engaging position of the spring 123 with the casing 100 and the biasing direction of said spring may be suitably selected in such a manner that the stored state or the capping state is normally obtained. In the former case, there may be provided a protective cover for protecting the recording head 110 when the cartridge 1 is still unused or detached.

A gear portion 122 is integrally provided on the rocking arm 121 and meshes with the driving gear 44 for receiving the driving force. However, the above-explained transmission mechanism can be constructed in any desirable manner.

Figure 18:
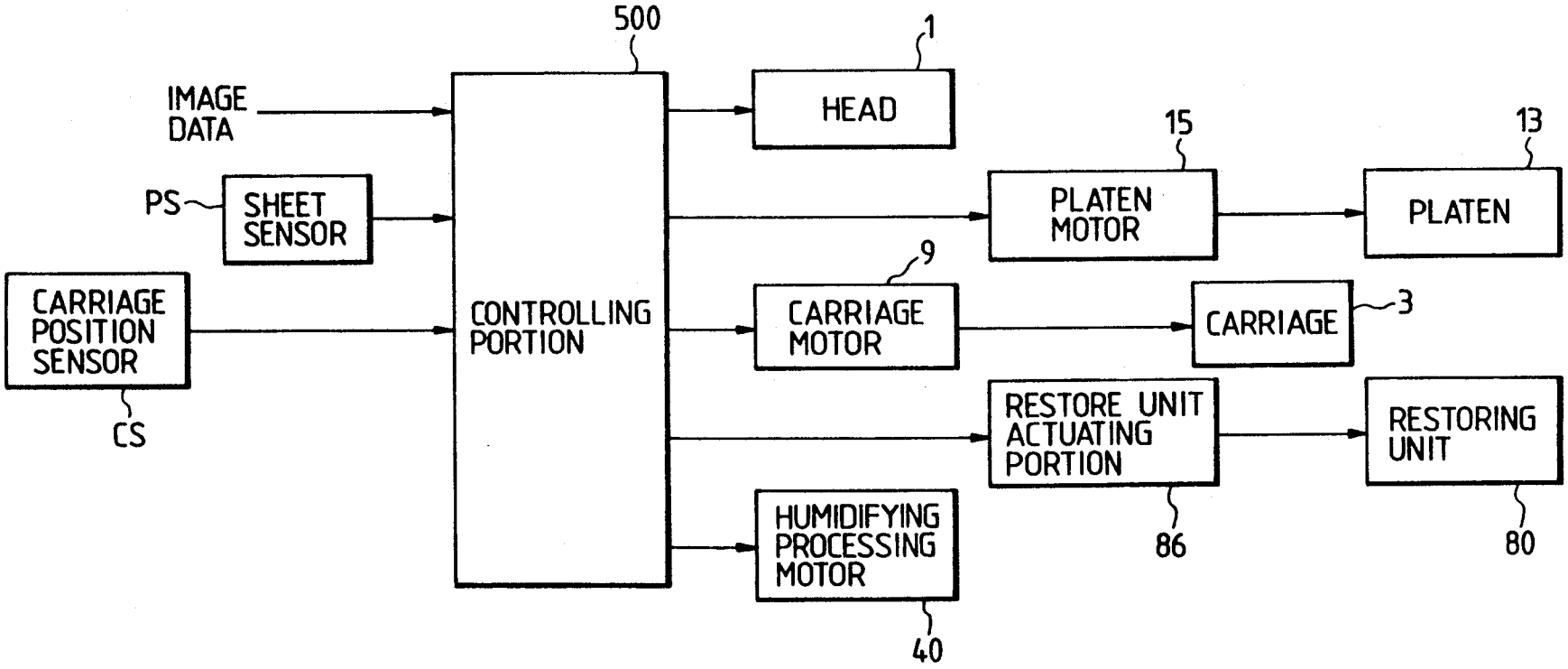
FIG. 18 is a block diagram showing one construction of a controlling system.

FIG. 18 shows an example of the humidifying control unit of the present embodiment, constructed as a part of the control system of the recording apparatus.

A control unit 500, composed of a microcomputer provided for example with CPU, ROM, RAM etc., controls various components according to a control program stored in the ROM, and controls the recording and other operations by driving the recording head 1 according to the image data received for example from a host apparatus. Also, it controls the advancement of the recording medium by driving the platen roller 13 through the platen driving motor 15 in response to the detection of the recording medium P by a sensor PS, and controls the movement of the carriage 3 and the return thereof to the home position, through the carriage motor 9, in response to the carriage position information detected by the carriage position sensor CS.

A recovery unit 80 is provided at a predetermined position (for example home position) outside the image recording range of the recording head 110, so as to be able to oppose to the discharge opening face 112 of the recording head 110, and, in the discharge recovery operation of the recording head 110, is moved relative thereto by a driving unit 86 under the control of the control unit 500.

The discharge recovery operation, for eliminating the viscosified ink, bubbles or dust dust particles from the recording head 110, can be achieved by ink discharge ("preliminary discharge") by normal drive of the recording head 110, or by ink suction from said head 110 with a pump provided in the recovery unit 80. Also, in case the ink is supplied from an ink supply system of the apparatus to the recording head 110, instead of the ink tank 150 provided in the cartridge 1, the ink discharge can also be achieved by pressurizing said ink supply system.

In case the recovery operation is conducted by the preliminary discharge, there may be dispensed with driving means for bringing the recovery unit 80 in contact with the recording head 110 a pause of the recording operation, since the capping operation is conducted with the cap 160. Furthermore, the recovery unit 80 may be dispensed with if such preliminary discharge is conducted onto the recording medium.

Furthermore, the control unit 500 controls the motor 40 for bringing the cap 160 to the capping position at the humidifying operation or during a pause of the recording operation, and bringing the cap 160 to the stored position at the recording operation.

Figure 19:
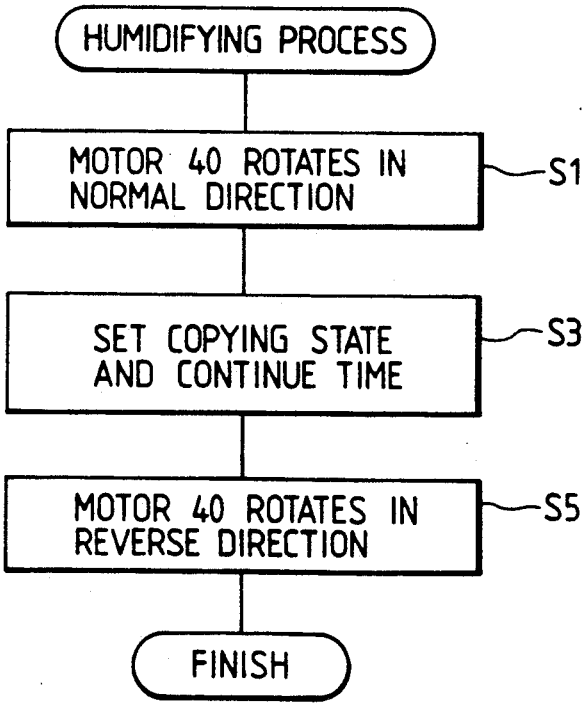
FIG. 19 is a flow-chart showing a sequence of the humidifying process of the present invention.

FIG. 19 shows an example of the humidifying routine or process in the present embodiment.

In this routine, a step S1 activates the motor 40 in the forward direction. In response the rocking arms 121, 120 rotate anticlockwise in FIG. 16, whereby, as shown in FIG. 17A, the containing member 162 of the cap 160 is brought into contact with the discharge opening face 112 to achieve application of the humidifying agent thereto. Such operation can be achieved, in the present embodiment, at a carriage position outside the image recording range.

After this state is continued for a suitable period (step S3), a step S5 reverses the motor 40 to bring the cap 160 in a position shown in FIG. 17B. This state is maintained by the spring 123, so that the recording operation is not hindered. Also in this state the interior of the ink tank 150 communicates with the external air through the apertures 106, 154, whereby smooth ink supply to the recording head 110 is ensured.

The above-explained routine can be activated at a suitable timing, for example at the start of power supply in the apparatus, at the start of the recording operation, after the discharge recovery operation, after the lapse of a predetermined period or after the recording operation of a predetermined amount.

If the recording operation is not conducted immediately after the above-explained routine, the step S5 may be skipped so that the cap 160 continues to be fitted on the discharge opening face 112. Also in case of a pause after the recording operation, the cap 160 is fitted on the discharge opening face 112. The capping on the face 112 protects the discharge openings from ink evaporation or dust deposition, and also prevents ink evaporation from the ink tank 150, since it is sealed from the air. Besides, when the ink cartridge 1 is still unused or detached from the carriage 3, the capped state is maintained by the spring 123 to attain similar protection.

The foregoing embodiment, in which the discharge opening face is maintained humidified during the recording operation by a humidifying operation combined with capping, protects the area in the vicinity of the discharge openings from drying, so that the failure in ink discharge resulting from increase in viscosity of the ink can be suppressed even when the frequency of ink discharges or recovery operations by the ink discharge is reduced. It is therefore rendered possible to increase the overall recording speed, and to avoid unnecessary waste of ink. Furthermore, in the capped state, the aperture 106 of the casing is also closed whereby the vapor pressure in the cartridge 1 is increased to achieve more effective heat protection.

Furthermore, since the humidifying means and the recording head 110 are integrated into a cartridge, the service life of the humidifying means can be selected corresponding to that of the recording head 110. Also high image quality can be maintained for a long time, since the humidifying means is replaced simultaneously with the replacement of the recording head 110.

Furthermore, since the humidifying means can be positioned spatially close to the discharge opening face 112, it is possible to reduce the probability of contamination with dust particles or the like at the humidifying operation, so that the reliability and the response of the humidifying operation can be improved.

In addition, the humidifying operation can be executed in the cartridge itself, scarcely relying on the structure of the main body of the recording apparatus, with little limitation in the timing of said operation and with reduced period of pause of the main body.

Also, since the capping is achieved by a substantially horizontal movement of the containing member 162 with respect to the discharge opening face 112, there can be reduced the retraction of ink meniscus in the discharge openings and air intake thereinto.

In addition, as the timing of the humidifying operation can be arbitrarily selected, it is easily possible to continue and maximize the effect of the humidifying operation.

Figure 20A:
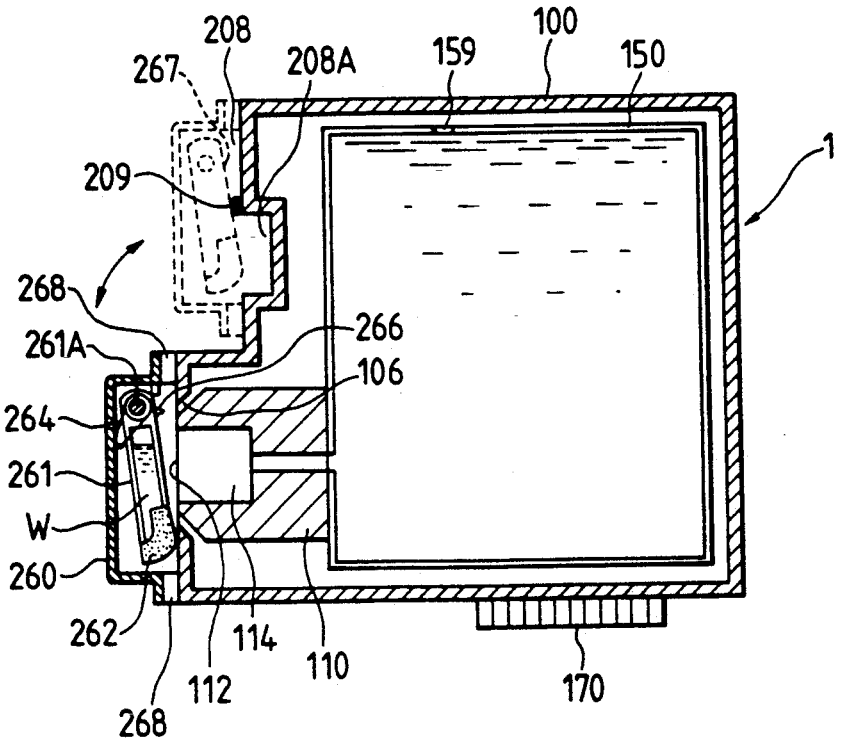
FIG. 20A shows the cartridge of another embodiment.
Figure 20B:
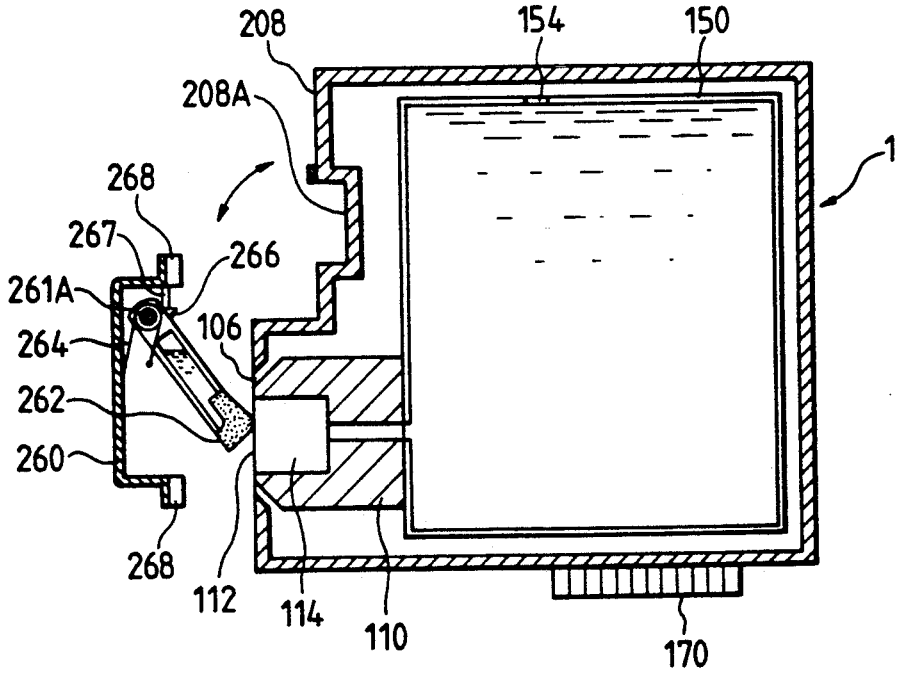
FIG. 20B is a side view for explaining the operation of the same.

FIGS. 20A and 20B show another embodiment of the present invention in which the humidifying operation is conducted only during movement to the capping position and during movement therefrom, in contrast to the foregoing embodiment in which the containing member 162 is constantly in contact with the discharge opening face 112 during the capping operation.

A cap 260 of the present embodiment can be placed in a capping position (solid-lined) in FIG. 20A and a stored position (broken-lined). A hollow rocking arm 261 provided in the cap 260 is rotatable about a shaft 261A, stores the humidifying agent W in the hollow part, and is provided at the end with a containing member 262 serving to be impregnated with the humidifying agent. A spring 264 biases the rocking arm 261 anticlockwise, in a direction that the end of said arm protrudes from the cap 264. An engaging portion 266 provided on the arm 261 and a stopper 267 provided on the cap 260 mutually cooperate to limit the rotating motion of the rocking arm 261.

A storage portion 208 is so formed that the cap 260 in the stored state does not protrude from the plane of the discharge opening face 112, and is provided with a recess 208A in order to avoid the contact of the containing member 262 of the arm 261. A stopper 209 is provided to engage with the arm 261 in the stored state thereof for limiting the movement of the arm 261.

A sealing member 268 seals the interior of the cap 260 from the external air at the capping position and the stored position thereof, thereby protecting, in the capping position, the discharge opening face 112 and the containing member 262 from drying and dust particles and closing the aperture 106 of the casing to prevent the ink evaporation from the ink tank 150, and, in the stored position, protecting the containing member 262 from dust particles and drying.

In the above-explained structure, the movement and positioning of the cap 260 can be achieved by a mechanism and a control sequence similar to those in the foregoing embodiment. In the capping state, the dyes in the ink do not diffuse into the humidifying agent, since the containing member 262 is not in contact with the discharge opening face 112.

However, at the movement to the capping position or at the movement therefrom, the containing member 262 moves in contact with the discharge opening face 112, as shown in FIG. 20B, by the rotating force of the arm 261 biased by the spring 264. Thus, in these movements, the humidifying agent is applied onto the discharge opening face 112, and it is also cleaned by wiping with the containing member 262. If sufficient application of the humidifying agent cannot be obtained by an open/-closing motion of the cap, there may be conducted plural operations.

The present embodiment also provides, as in the foregoing embodiment, advantages of the humidifying operation, of integrating the humidifying means with the recording head, and of positioning the two in close vicinity. In addition, the humidifying agent is adequately agitated by the acceleration of carriage movement, due to the use of a reservoir member containing liquid humidifying agent. This is desirable because the humidifying agent can be advantageously homogenized by the agitation but is little affected by foaming.

The present embodiment is not limited to the foregoing examples, but the structure, mode of humidifying agent application and mechanism therefor can be arbitrarily selected as long as the recording head and the humidifying means are mutually integrated.

For example, the humidifying operation for the discharge opening face 112 of the recording head 110 may be conducted without the containing member 162 or 262 impregnated with the humidifying agent or receiving the supply thereof. For example, it is possible to supply a containing member composed of spongy porous material with ink by discharge from the recording head 110 and utilize said ink as the humidifying agent. In this case, it is preferable to absorb the dyes of the ink into the containing member and to apply the liquid component only.

The above-mentioned ink is principally composed of dyes or pigments serving as the coloring material and a liquid medium for dissolving or dispersing said dyes or pigment, with eventual various additives, and the coloring material is generally composed of watersoluble direct dyes or acid dyes while the liquid medium is composed of water or the components mentioned before with respect to the humidifying agent. cl Embodiment 3

In the present embodiment, the amount of movement of the motor is controlled, in the mounted state of the cartridge 1 shown in FIG. 4, from the turning-off of the microswitch 48 by the engagement of the actuator 48A with the aperture 122 of the tape 120, thereby positioning the aperture 122 at the discharge opening face 112 to enable the recording operation or capping said face when the recording head is not in use.

In the present embodiment, the basic structure of the ink jet recording apparatus and the control sequence therefor are substantially the same as those in the embodiment 1. However, since the capping is achieved by a portion of the tape 120 as explained later, there may be dispensed with the drive means for bringing the recovery unit 80 into contact with the recording head 110 in the non-recording period, if the recovery of ink discharge is conducted by preliminary discharge. Also, the recovery unit 80 itself may be dispensed with if such preliminary discharge is conducted onto the recording medium.

Figure 21:
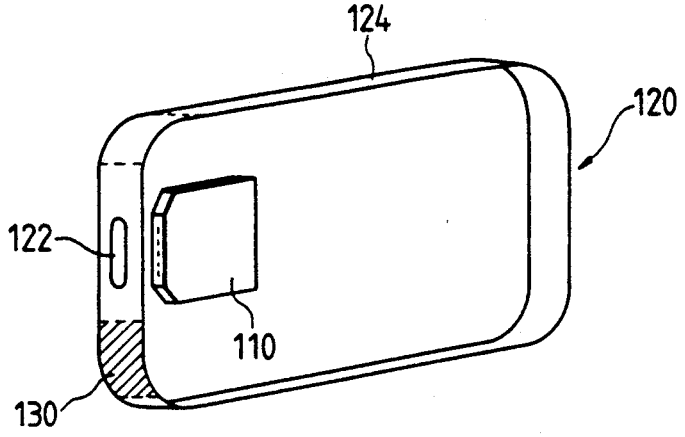
FIGS. 21 and 22 are explanatory drawings for explaining construction of the tape used in one embodiment of the present invention.

FIG. 21 shows an example of the structure of the tape 120 employed in the present embodiment.

The tape 120 of the present embodiment is provided with an aperture 122 for enabling ink discharge at the recording operation, a capping portion 130 for covering the discharge opening face 112 when the apparatus is not in use, and a humidifying portion 124 for receiving the humidifying agent from the containing member 162 and transferring the same onto said discharge opening face 112.

In the present embodiment the aperture 122 is so sized as to expose the discharge opening face 112 and to open the aperture 106 of the casing thereby leaving the aperture 154 of the ink tank 150 in communication with the external air at the recording operation, and the capping portion 130 is so sized as to cover the discharge opening face 112 and to cover said aperture 106 thereby preventing ink evaporation from the aperture 154 in the non-recording state.

In the following there will be explained the tape 120 employed as a part of the humidifying means in the present embodiment.

At first, there will be explained the materials constituting the tape 120.

The tape 120 has to satisfy following requirements (i) a high tensile strength;

(ii) high flexibility, in order to achieve intimate contact with the discharge opening face 112 of the recording head 110 thereby realizing satisfactory humidifying and capping;

(iii) satisfactory sliding performance, for achieving contact with the face 112; and (iv) easy surface modification, for achieving satisfactory transfer of the humidifying agent, or for accepting surface modification or depositing another material for improving said transfer or the capping operation.

In consideration of the foregoing, the tape 120 can be composed of a polymer film for example of polyethylene terephthalate (PET), polyimide (PI), polytetrafluoroethylene-perfluoroacrylvinylether copolymer (PFA) or polyvinyl alcohol (PVA), reinforced paper or a metal foil such as aluminum.

Figure 22:
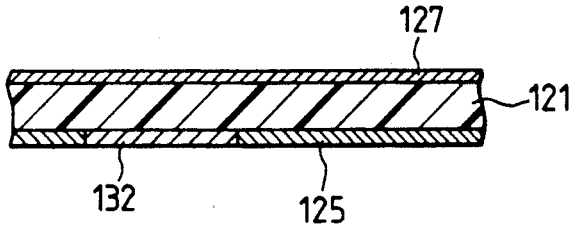

FIG. 22 shows an example of the structure of the tape 120, composed of a tape substrate (base) 121, a humidifying layer 125 functioning as the above-mentioned humidifying portion 124, and a capping layer 132 functioning as the above-mentioned capping portion 130. An antistatic layer 127 is provided on the front surface of the tape 120 for preventing dust deposition by static charge, and can be formed by metal evaporation or mixing of fine powder of a conductive material such as carbon.

The humidifying portion 124 formed on a surface (to be in contact with the containing member 162 and the discharge opening face 112 in the present embodiment) of the tape 120 is preferably easily humidifyable with the humidifying agent and capable of retaining the humid state for a certain period, and it is therefore advantageous to improve the liquid absorption by surface modification such as forming porousness or surface irregularities. On the other hand, if the capping portion 130, which is maintained in contact with the face 112 during the non-recording state, contains the humidifying agent, the ink in the discharge opening may be diluted by the humidifying agent. For preventing such phenomenon, the capping portion is preferably made repellent to the humidifying agent. In consideration of the foregoing, there can be proposed:

(i) to form a finely coarse surface to obtain liquid-absorbing humidifying portion 124;

(ii) to form fine surface irregularities by mixing fine particles in the resin used for tape molding or by ultraviolet irradiation and to retain the humidifying agent in said irregularities;

(iii) to coat the surface with a moisture-absorbing and foaming material such as PVA and a liquid-repellent material thereby respectively forming the humidifying portion and the capping portion; or (iv) to adhere a material of humidifying function and a material of capping function to the above-mentioned tape substrate and to laminate said materials therewith, thereby forming the humidifying portion and the capping portion.

Also the capping portion 130 may be composed of a smooth surface of the resinous film itself or a smooth surface obtained by evaporation of a metal such as aluminum onto said film. In this manner, there is obtained intimate contact with the discharge opening face 112 for preventing ink evaporation from the discharge openings when they are not in use. It is also possible to replace a part of the resinous tape with a thin metal foil as the capping portion.

The containing member and the humidifying agent can be the same as those employed in the embodiment 1.

In the present embodiment, the control unit 500 shown in FIG. 8 may be employed for controlling the recovery unit 80 through the drive unit 86 thereby effecting the capping of the recording head 110 or the discharge recovery thereof, but, as explained before, such structure is not essential. The control unit 500 also controls the motor 40 for tape driving, thereby effecting the tape advancement at the humidifying operation or the positioning of the aperture 122 and the capping portion 130, according to the state of the switch 48.

FIG. 23 A shows an example of the humidifying routine in the present embodiment.

When this routine is activated, a step S1 activates the motor 40 for moving the tape 120 in the direction A shown in FIG. 3, whereby the humidifying agent is given by the containing member 162 to the humidifying portion 124 (humidifying layer 125) of the tape 120, and is applied to the discharge opening face 112 upon arrival thereat.

Then a step S3 discriminates, according to the signal from the switch 48, whether the aperture 122 has passed the position of said switch. If the result of said discrimination is affirmative, the motor 40 continues to be driven for the known length of the tape 120 (the humidifying agent continues to be applied to the discharge opening face 112), and the motor 40 is stopped when the aperture 122 reaches the discharge opening face 112 (step S5). If the recording operation is not conducted immediately thereafter, the capping portion 130 may be placed on the discharge opening face 112.

The amount of movement of the tape 120 from the start to the end of rotation of the motor 40, or the number of turns of the endless tape 120 can be one turn or several turns as long as the humidifying is appropriately conducted. Also it can be less than one turn if the tape 120 is provided with plural apertures 122.

Also the above-mentioned routine can be activated at a suitable timing, such as at the start of power supply in the apparatus, at the start of the recording operation, after the discharge recovery operation, after the lapse of or a predetermined period of after the recording operation of a predetermined amount. Also, the humidifying operation need not be carried out outside the image recording range, but can be executed for example during the returning motion of the carriage 3, since no members protrude toward the platen roller 13 in the present embodiment. It can also be conducted, by interrupting the recording operation, at the carriage position at said interruption.

Figure 23B:
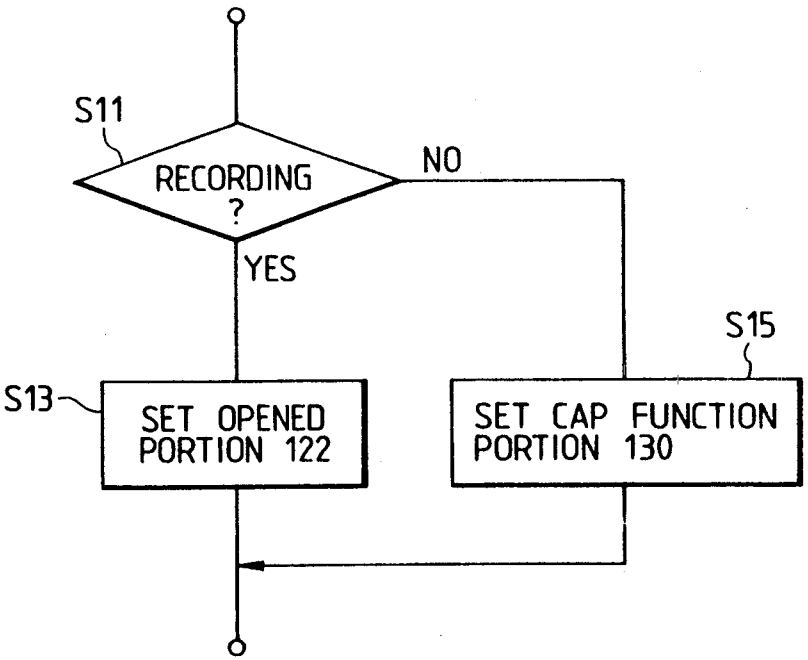
FIGS. 23A and 23B are flow-charts showing processing sequence in one embodiment of the present invention.

FIG. 23B shows an example of routine for setting the aperture 122 or the capping portion 130 of the tape 120 onto the discharge opening face 112 and the aperture 106.

At first a step S11 discriminates, at a suitable timing, whether the recording operation is to be started or not. Said discrimination is conducted when the control unit 500 receives a recording instruction signal, or at the start of recording of a line, or at the carriage return after the recording of a line. This routine may be added to the routine shown in FIG. 23A.

If the result of said discrimination is affirmative, a step S13 sets the aperture 122. If the capping portion 130 has been placed, the setting can be achieved by moving the tape 120 in the direction A shown in FIG. 3 or in the opposite direction. This setting exposes the discharge opening face 112 to enable the ink discharge, and allows the interior of the ink tank 150 to communicate with the external air through the apertures 106 and 154, thereby ensuring smooth ink supply to the recording head 110.

On the other hand, if the result of the discrimination in the step S11 is negative, a step S15 sets the capping portion 130. The capping on the discharge opening face 112 protects the discharge openings from ink evaporation and dust deposition, and seals the ink tank 150 from the external air to prevent the ink evaporation therefrom.

In addition to the advantages achieved in the embodiment 1, the present embodiment provides an advantage of preventing the retraction of ink meniscus in the discharge openings and the air intake therein, since the application of a humidifying agent and the capping are achieved by sliding contact of the tape 120 with the face 112. Also the use of thin tape 120 enables compactization of the cartridge 1, humidifying operation and capping operation in the image recording range, and the flexibility of said tape 120 realizes intimate contact with the discharge opening face 112, thereby improving the humidifying and capping performance. In addition the use of tape allows to separate various functional portions and to enlarge each portion sufficiently.

Also excellent protection of the recording head can be achieved since the response of capping can be improved and the discharge opening face can be immediately capped in the non-recording state.

The structure for humidifying agent application onto the discharge opening face 112 with a tape-shaped member is not limited to the foregoing example.

For example, as shown in FIG. 10, the tape 120-1 can be supported at both ends by elastic members 120-2 such as springs instead of being shaped in an endless form, whereby the contact of the tape 120-1 to the face 112 can be improved by the tension of the elastic members 120-2 and the tape 120-1 is moved in a direction A at the humidifying operation and is thereafter moved in a direction B, thereby achieving the application of humidifying agent and the positioning of the aperture 122 or the capping portion 130.

The present example not only provides the advantages as in the foregoing embodiments but also contributes to cost reduction, owing to the ease of assembly and tape preparation. It also provides an advantage that the reference position can be easily selected. For example, a position in which the capping portion 130 covers the discharge opening face 112 and the aperture 106 of the casing is selected as the balanced position of the elastic members 120-2.

Also a structure as shown in FIG. 11 may be adopted to effect the humidifying operation on the discharge opening face 112 of the recording head 110 without the humidifying agent chamber.

In these embodiments the path and running direction of the tape can naturally be selected arbitrarily as long as the face 112 can be effectively humidified. For example, instead of tape running in the vertical plane in the foregoing embodiments, there may be employed tape running in the horizontal direction.

Figure 24:
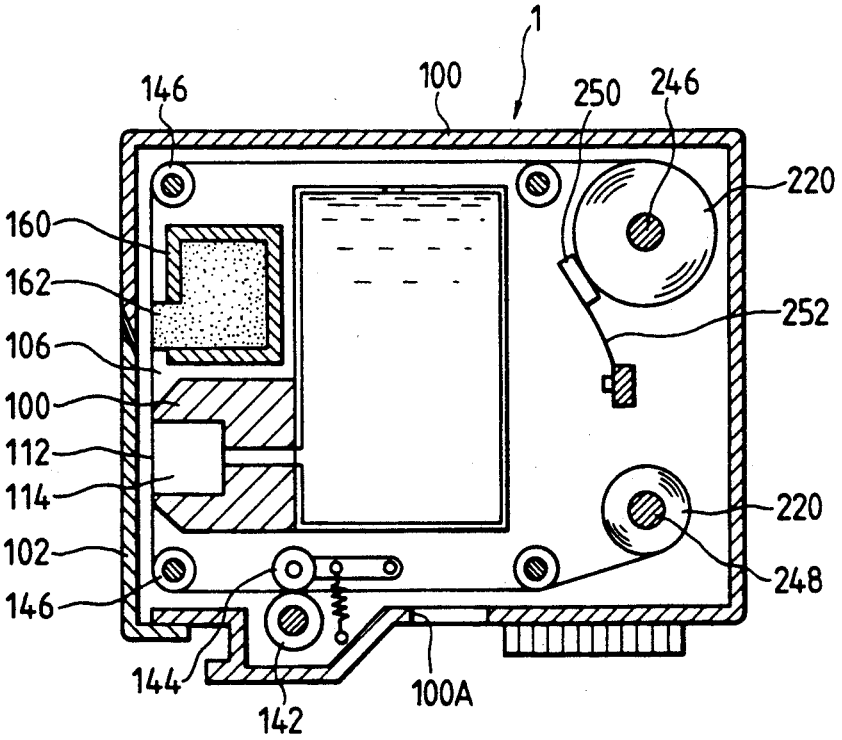
FIG. 24 is a cross section showing another embodiment of the cartridge.

FIG. 24 shows another embodiment, in which the tape is used one time only, in contrast to the foregoing embodiments in which the tape 120 is repeatedly used by rotating or reciprocating motion.

In FIG. 24, there are shown a tape 220 to be used one time; an idler shaft 246 bearing the unused portion of the tape 220; and a taking-up shaft 248 for winding the used portion of the tape. The taking-up shaft 248 can be rotated through a suitable transmission mechanism such as gears. A sliding member 250 is maintained in contact with the tape 220 wound on the idler shaft 246, and is biased by a plate spring 252 to prevent slack in the tape.

In the present embodiment, plural sets of the capping portion, aperture and humidifying portion are provided, in this order, from the side of the taking-up shaft 248 to the idler shaft 246.

During the storage of an unused cartridge or when a half-used cartridge is detached, it is preferable that the discharge opening face 112 and the aperture 106 of the casing are covered by the capping portion. Such state can be obtained in the stage of manufacture or in the setting for the non-recording stage (cf. FIG. 9B), but undesirable evaporation or dilution of ink will result if the aperture or the humidifying portion of the tape is positioned. The following structure may therefore be employed in order to avoid such inconvenience.

Figure 25A:
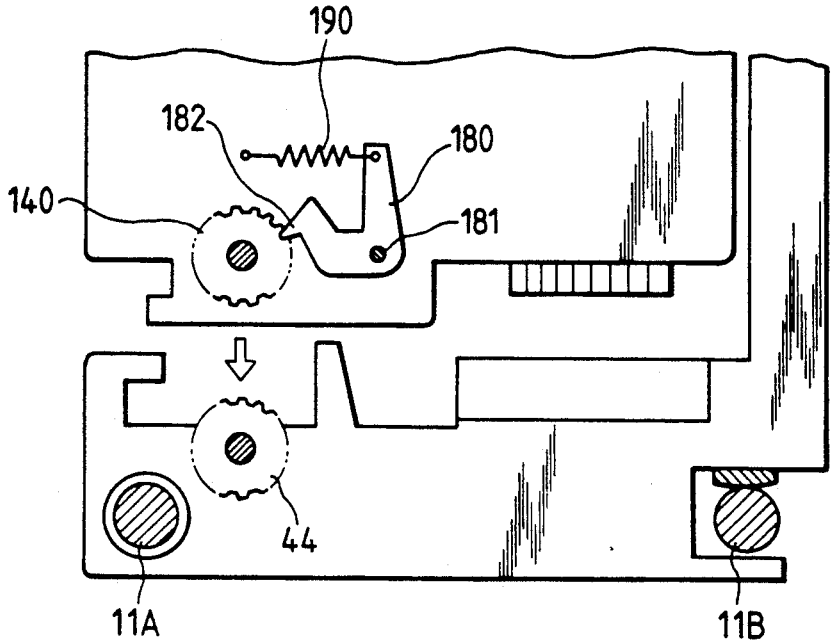
FIG. 25A shows another mechanism adoptable for setting of a tape portion.

FIGS. 25A and 258 show an example of the structure for maintaining the capped state for example when the cartridge is unused.

There are shown a stopper arm 180; a rotary shaft 181 therefor; a latch 182 for engaging with the tape driving gear 140 to stop the rotation thereof; and a spring 190 for biasing the stopper arm 180 for causing the latch 182 to engage with the gear 140. A push-up member 38 engages with the stopper arm 180 in response to the mounting of the cartridge 1 and pushes up said arm against the biasing force of the spring 190, thereby disengaging the latch 182 from the gear 140.

Figure 25B:
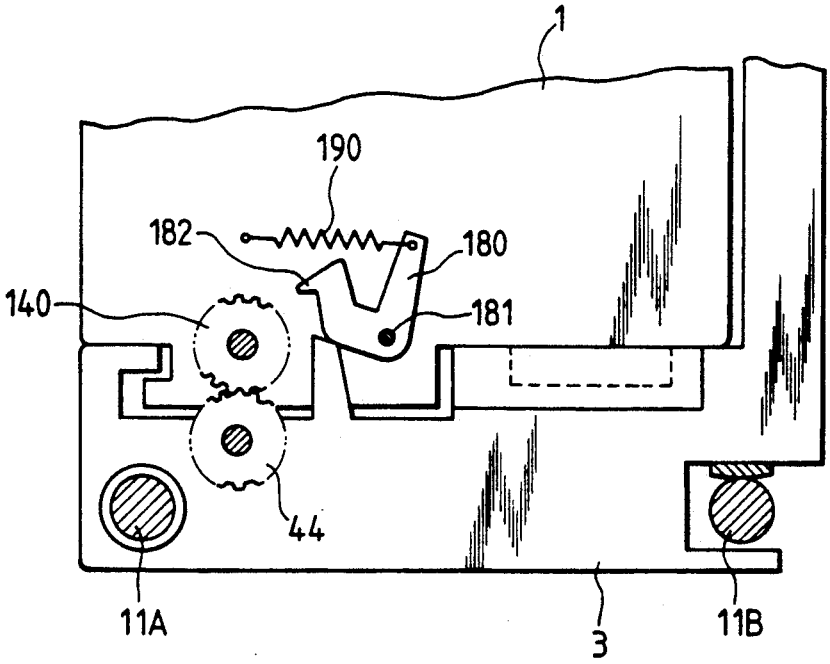
FIG. 25B is a side view showing the operation of the same.

When the cartridge 1 is not mounted on the carriage 3, as shown in FIG. 25A, the rotation of the gear 140, or the movement of the tape, is prohibited by the latch 182 of the stopper arm 180 under the effect of the spring 190, so that the capped state is maintained. On the other hand, when the cartridge 1 is mounted, the gear 140 can be driven by the gear 44 as shown in FIG. 25B.

Figure 26:
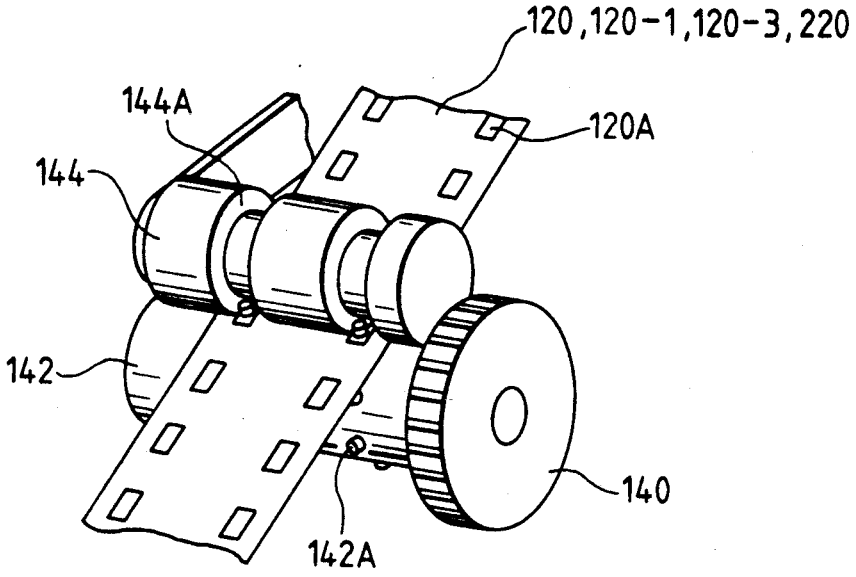
FIG. 26 is a perspective view showing a mechanism adoptable for the tape feeding system.

It is also possible to provide, as shown in FIG. 26, the tape 120, 120-1, 120-3 or 220 with perforations 120A and to provide the driving roller 142 with pins 142A engaging with said perforations and the pinch roller 144 with a groove 144A corresponding to said pins 142A, thereby preventing slippage of the tape, thus maintaining the set state of the capping portion, preventing the skewed advancement and improving the precision of drive.

The present invention is not limited to the foregoing embodiments, but, as long as a tape having an aperture, a capping portion and a humidifying portion is provided in a cartridge equipped with a recording head, there may be arbitrarily selected the structures of these components, mode of application of the humidifying agent to the discharge opening face or to the humidifying portion, and mechanism therefor.

For example the application of the humidifying agent to the humidifying portion can be achieved by passing the tape in a reservoir of the humidifying agent or employing rollers impregnated with the humidifying agent as at least a part of the transport rollers 146, or employing rollers for picking up the humidifying agent from a suitable reservoir therefor. Furthermore, in the structure shown in FIG. 24, the tape 220 wound on the idler shaft 246 can be immersed in the humidifying agent in a reservoir. The presence of such reservoir provides an additional advantage of maintaining a suitable vapor pressure in the cartridge 1.

Embodiment 4

In the present embodiment, the amount of movement of the motor is controlled, in the mounted state of the cartridge 1, from the turning-off of the microswitch 48 by the engagement of the actuator 48A with the aperture 122 engagement of the actuator 48A with the aperture 122 of the tape 120, thereby positioning the aperture 122 at the discharge opening face 112 to enable the recording operation or capping said face when the recording head is not in use. A cleaning portion is brought into sliding contact with the discharge opening face 112 prior to the sliding contact of the humidifying portion, as will be explained later.

In the present embodiment, the basic structure of the ink jet recording apparatus and the control sequence therefor are substantially the same as those in the embodiment 3.

Figure 27:
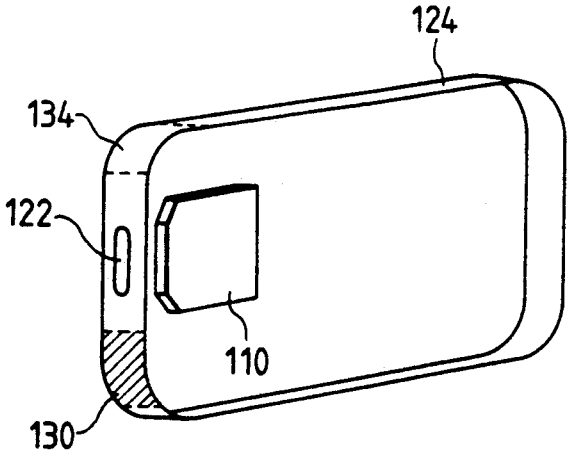
FIGS. 27 and 28 are explanatory drawings for explaining construction of the tape used in one embodiment of the present invention.

FIG. 27 shows an example of the structure of the tape 120 employed in the present embodiment.

The tape 120 of the present embodiment is provided with an aperture 122 for enabling ink discharge at the recording operation, a capping portion 130 for covering the discharge opening face 112 when the apparatus is not in use, a humidifying portion 124 for receiving the humidifying agent from the containing member 162 and transferring said humidifying agent onto said face 112, and a cleaning portion 134 to be brought into sliding contact with said face 112 preceding said humidifying portion 124 in a movement shown in FIG. 3.

In the present embodiment, the aperture 122 is so sized as to expose the discharge opening face 112 and to open the aperture 106 of the casing thereby enabling the aperture 154 of the ink tank 150 in communication with the external air at the recording operation, and the capping portion 130 is so sized as to cover the discharge opening face 112 and also to cover said aperture 106 thereby preventing ink evaporation from the aperture 154 in the non-recording state.

In the following there will be explained the tape 120 employed as a part of humidifying means in the present embodiment.

At first there will be explained the materials constituting the tape 120.

The tape 120 has to satisfy following requirements:

(i) a high tensile strength;

(ii) high flexibility, in order to achieve intimate contact with the discharge opening face 112 of the recording head 110 thereby realizing satisfactory humidifying and capping;

(iii) satisfactory sliding performance, for achieving contact with the face 112; and (iv) easy surface modification, for achieving satisfactory transfer of the humidifying agent, or for accepting surface modification or depositing another material for improving said transfer or the capping operation.

In consideration of the foregoing, the tape 120 can be composed of a polymer film for example of polyethylene terephthalate (PET), polyimide (PI), polytetrafluoroethylene-perfluoroacrylvinylether copolymre (PFA) or polyvinyl alcohol (PVA), reinforced paper or a metal foil such as aluminum.

Figure 28:
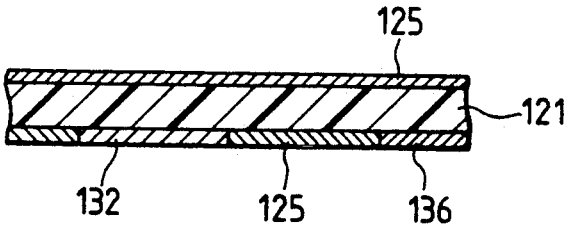

FIG. 28 shows an example of the structure of the tape 120, composed of a tape substrate (base) 121, a humidifying layer 125 functioning as the above-mentioned humidifying portion 124, a cleaning layer 136 functioning as the cleaning portion 134, and a capping layer 132 functioning as the capping portion 130. An antistatic layer 127 is provided on the front surface of the tape 120 for preventing dust deposition by static charge and can be formed by metal evaporation or mixing of fine powder of a conductive material such as carbon.

The humidifying portion 124 formed on a surface (to be in contact with the containing member 162 and the discharge opening face 112 in the present embodiment) of the tape 120 is preferably easily humidifiable with the humidifying agent and capable of retaining the humid state for a certain period, and it is therefore advantageous to improve the liquid absorption by surface modification such as forming porousness or surface irregularities. On the other hand, if the capping portion 130, which is maintained in contact with the face 112 during the non-recording state, contains the humidifying agent, the ink in the discharge opening may be diluted by the humidifying agent. For preventing such phenomenon, the capping portion is preferably made repellent to the humidifying agent. Also the cleaning portion 134 should preferably be capable of not only wiping the dusts and solidified ink adhering to the discharge opening face 112 but also effecting such wiping operation after swelling for example with the humidifying agent. In consideration of the foregoing, there can be proposed:

(i) to form fine coarse surface to obtain the cleaning portion 134 and humidifying portion 124 capable of liquid absorption;

(ii) to form fine surface irregularities by mixing fine particles in the resin used for tape molding or by ultraviolet irradiation thereby forming the humidifying and cleaning portions and to retain the humidifying agent in said irregularities:

(iii) to coat the surface with a moisture-absorbing and foaming material such as PVA and a liquid-repellent material thereby forming the humidifying portion, cleaning portion and capping portion; or (iv) to laminate a material of humidifying function, a material of cleaning function and a material of capping function, thereby forming the humidifying portion, cleaning portion and capping portion, respectively.

Also the capping portion 130 may be composed of a smooth surface of the resinous film itself or a smooth surface obtained by evaporation of a metal such as aluminum onto said film. In this manner, there is obtained intimate contact with the discharge opening face 112 for preventing ink evaporation from the discharge openings when they are not in use. It is also possible to replace a part of the resinous tape with a thin metal foil as the capping portion.

The cleaning portion 134 can be formed by coating or lamination of polyurethane foam, PVA or various rubber materials on the substrate composed of a resinous film or a thin metal foil. There are required such surface characteristics not damaging the discharge openings as said cleaning portion moves in sliding contact therewith.

The containing member and the humidifying agent can be the same as those employed in the embodiment 1.

In the present embodiment, the control unit 500 shown in FIG. 8 may be employed for controlling the recovery unit 80 through the drive unit 86 thereby effecting the capping of the recording head 110 or the discharge recovery thereof, but, as explained before, such structure is not essential. The control unit 500 also controls the motor 40 for tape driving, thereby effecting the tape advancement at the humidifying operation or the positioning of the aperture 122, capping portion 130 and cleaning portion 134, according to the state of the switch 48.

Figure 23A:
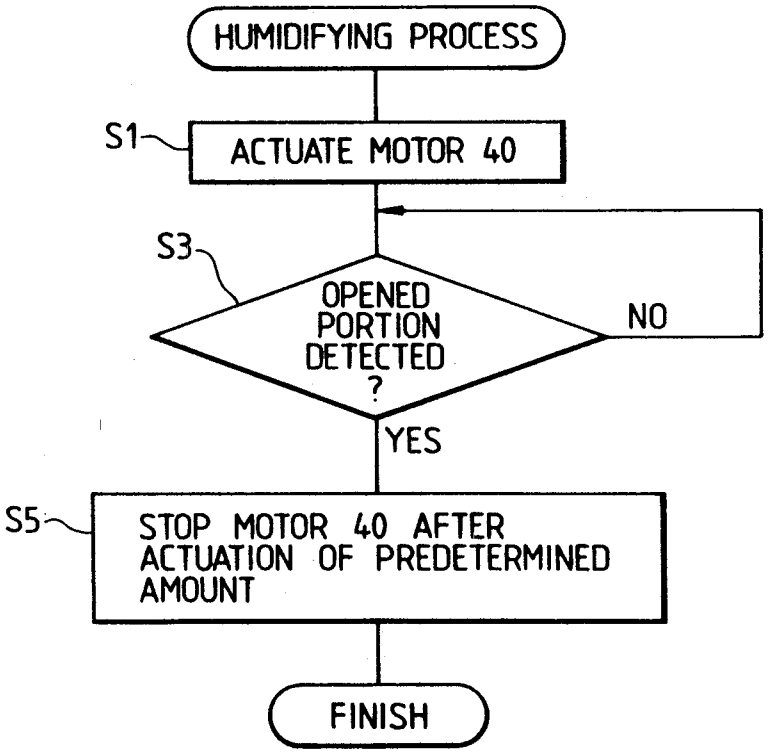

In the following there will be explained an example of the humidifying routine in the present embodiment, with reference to FIG. 23A.

When this routine is activated, a step Sl activates the motor 40 for moving the tape 120 in the direction A shown in FIG. 3, whereby the cleaning portion 134 slides on the discharge opening face 112 to achieve the cleaning thereof, and the humidifying agent is given by the containing member 162 to the humidifying portion 124 (humidifying layer 125) of the tape 120, and is applied to the discharge opening face 112 upon arrival thereat. Said application is conducted after said face 112 is cleaned by the cleaning portion 134.

Then a step S3 discriminates, according to the signal from the switch 48, whether the aperture 22 has passed the position of said switch. If the result of said discrimination is affirmative, the motor 40 continues to be driven for the known length of the tape 120 (the humidifying agent continues to be applied to the discharge opening face 112), and the motor 40 is stopped when the aperture 122 reaches the discharge opening face 112 (step S5). If the recording operation is not conducted immediately thereafter, the capping portion 130 may be placed on said face 112.

The sequence of setting the aperture 122 or the capping portion 130 of the tape 120 onto the discharge opening face 112 and the aperture 106 is the same as already explained in relation to FIG. 23B.

In addition to the advantages achieved in the embodiment 3, the present embodiment provides an advantage of improved effect of humidifying, since the discharge opening face is cleaned sufficiently prior to the humidifying.

Also the present embodiment provides an advantage of preventing the retraction of ink meniscus in the discharge openings and the air intake therein, since the application of a humidifying agent and the capping are achieved by sliding contact of the tape 120 with the face 112. Also the use of thin tape 120 enables compactization of the cartridge 1 humidifying operation and capping operation in the image recording range, and the flexibility of said tape 120 realizes intimate contact with the discharge opening face 112, thereby improving the cleaning, humidifying and capping performance. In addition, the use of tape allows to separate various functional portions and to enlarge each portion sufficiently.

The structure for humidifying agent application onto the discharge opening face 112 with a tape-shaped member is not limited to the foregoing example.

For example, as shown in FIG. 10, there can be employed a tape 120-1 supported at both ends by elastic members 120-2 such as springs instead of the endless tape, whereby the contact of the tape 120-1 to the face 112 can be improved by the tension of the elastic members 120-2 and the tape 120-1 is moved in a direction A at the humidifying operation and thereafter moved in a direction B, thereby achieving the cleaning operation, humidifying agent application and positioning of the aperture 122 or capping portion 130.

The present example not only provides the advantages as in the foregoing embodiments but also contributes to cost reduction, owing to the ease of assembly and tape preparation. It also provides an advantage that the reference position can be easily selected. For example a position in which the capping portion 130 covers the discharge opening face 112 and the aperture 106 of the casing is selected as the balanced position of the elastic members 120-2.

Also a structure as shown in FIG. 11 may be adopted to effect the humidifying operation on the discharge opening face 112 of the recording head 110 without the humidifying agent chamber.

In these embodiments, the path and running direction of the tape can naturally be selected arbitrarily as long as the face 112 can be effectively humidified. For example, instead of tape running in the vertical plane in the foregoing embodiments, there may be employed tape running in the horizontal direction.

Also the tape may be used one time only, as shown in FIG. 24, in contrast to the foregoing embodiments in which the tape 120 is repeatedly used by rotating or reciprocating motion.

Figure 29:
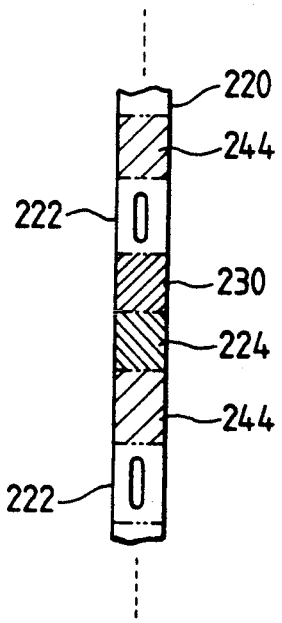
FIG. 29 is an explanatory drawing for explaining construction of the tape adoptable in one embodiment of the present invention.

In such case, as shown in FIG. 29, plural sets of capping portion 230, aperture 222, cleaning portion 234 and humidifying portion 224 can be provided in this order from the side of the take-up shaft 248 toward the idler shaft 246.

Figure 30:
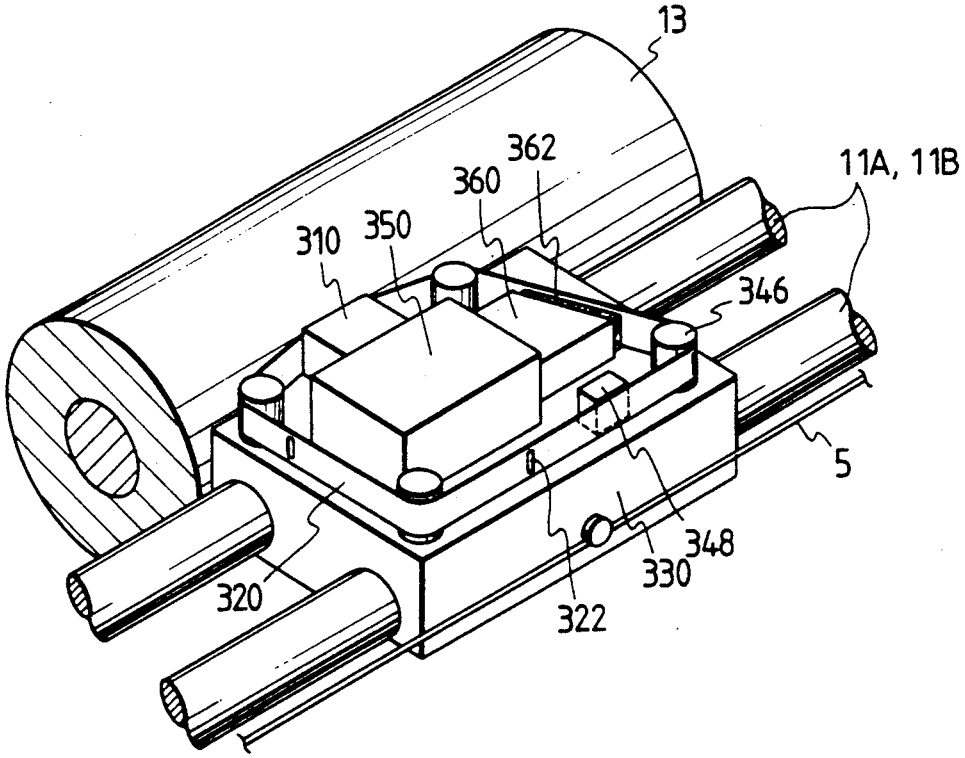
FIG. 30 is a perspective view for explaining another embodiment of the present invention.

In the above embodiment, the tape is provided within the cartridge having the recording head to be exchanged together with the recording head, but the present invention is not limited to the above embodiment. For example, the tape can be provided separately as shown in FIG. 30, in which the same reference numerals as that of FIG. 1 are used to designate the corresponding portions or elements.

Reference numeral 310 designates a recording head, 330 designates a carriage and 350 designates an ink tank. The recording head 310 can be a member fixed to the apparatus or can be a member to be exchanged. The ink tank 350 can be the cartridge type which is exchanged when no ink is remained, or can be the subtank type in which the ink is received from a ink supplying source (not shown) to supply the recording head 310. In other words, the recording head 350 and the ink tank can be exchanged integrally or can be exchanged individually as separate member, or only one of them can be an exchangeable member. Furthermore, exchange of the recording head and ink tank is not an essential premise. In the case the recording head 310 directly receives ink from the ink supplying source (not shown), the ink tank 350 need not be provided.

Reference numeral 310 designates a tape fed by a suitable actuating means (not shown) with scrubbing the discharge opening surface of the recording head 310, which tape has an opened portion 322 set in a position opposing the discharge opening of the recording head to expose the total discharge opening upon recording, and has a function to apply the humidifying agent to the discharge opening surface 310. The humidifying portion for achieving the above function can be the total surface or the part of it scrubbing the discharge opening surface. The humidifying function portion can be provided with a cupping function portion or cleaning portion.

Reference numeral 346 designates a guide roller provided on the carriage 330 to regulate the feeding path of the tape 310 for guiding it, 348 designates a sensor used for control in which passage of the opened portion 322 is detected to set position of it, which sensor 348 has the same function as the microswitch 48 explained with reference to FIG. 4.

The reference numeral 360 designates a container for containing the humidifying agent, which container has a pad 362 in the form of impregnated material having resiliency. The pad 362 comprises a portion dipped into the humidifying agent in the container and a portion being abutted to the tape 320 to apply the humidifying agent thereto and pressing it to apply the tension force to the tape 320. Due to presence of the pad 362, the tape 320 is stuck to the discharge opening surface of the recording head 310 to enable proper humidifying process. The humidifying agent container 360 can have the construction in which the impregnated material into which the humidifying agent is impregnated preliminarily, and in the case the ink is used as the humidifying agent the container need not be provided. The humidifying agent container 361 can be exchanged individually or together with the ink tank 360 and the recording head 310, or can be fixed to the carriage 330 to receive the supplement of the humidifying agent.

Also in the present, above-mentioned construction, member or material etc. can be selected as for humidifying means or the like, and the same advantage as above-mentioned can be obtained corresponding to the selection of function.

Heretofore, the typical embodiments of the present invention are described, but it is needless to say that the present invention should not be limited to these embodiment, in other words, construction of each embodiment can be combined as occasion demands.

According to the present invention in which humidifying means is made integral with the cartridge provided with liquid discharging means (recording head), humidifying means and the cartridge can be exchanged at same time, proper humidifying process can be maintained by setting lifetime of humidifying means considering lifetime of the recording head, and because humidifying means and the liquid discharging portion (discharging opening) to be humidified can be disposed in proximity to each other, danger of dust contamination is decreased.

Additionally, the cartridge can effect humidifying operation, capping and cleaning independently by receiving power from the main body of the recording head, so that construction of the recording apparatus will not be complexed.

According to the present invention because humidifying means for humidifying the recording head and the discharge opening surface thereof to prevent drying or increase of ink viscosity and/or cleaning means are provided on the integral cartridge, the lifetime of humidifying means and/or cleaning means can be set corresponding to the lifetime of the recording head. Since exchange of the humidifying agent and tape is carried out at the same time as that of the recording head, high recording quality can be maintained for a long time.

Furthermore, because humidifying means and discharge opening surface can be disposed in proximity in the space, foreign material such as dust would not enter upon humidifying operation, which increases responsibility and improve response of humidifying operation. In the case cleaning is carried out prior to humidifying, because humidifying liquid is applied to the discharge opening surface in proper condition, the efficiency is greatly improved.

Humidifying operation can be effected only by the cartridge not depending on construction of the main body of recording apparatus, which means not only restriction of the operating time is small but rest time of the main body is small.

Additionally, in the present invention, since the impregnated material and the discharge opening surface are positioned at a common or same side with respect to the tape so as not to hinder the recording, the mechanism or operation can be simplified.

Since application of the humidifying agent and the capping are carried out with the tape being brushed against the discharge opening surface, the retraction of meniscus of the ink in the discharge opening and intake of air can be prevented. Usage of the thin material such as the tape enable the cartridge to be compact and make the cleaning, humidifying process and capping in the image area possible. The tape fits to the discharge opening surfaces due to flexibility thereof to improve the cleaning state, humidifying function and capping property. Furthermore, usage of the tape makes possible to separate various functioning portions and to make the effective area of each functioning portion larger.

Additionally, the excellent response of capping can be obtained, and the discharge opening surface can be capped when the recording is not carried out, which is effective in protecting the recording head.

Additionally, in the case the application of the humidifying agent and the capping carried out through the lateral movement of humidifying means relative to the discharge opening surface are different from the case in which capping means is provided on the apparatus body to cap the discharge opening surface from front end thereof, shock applied can be reduced while the retraction of meniscus of the ink within the discharge opening and the intake of air can be prevented.

Since humidifying means is integrally provided on the cap member, not only the discharge opening can be sealed by the cap member but the discharge opening can be protected sufficiently.

We claim:

1. An ink jet cartridge removably mountable on a main body of an ink jet recording apparatus, the cartridge comprising:

a casing having means for removably mounting the cartridge on the apparatus;

an ink storing portion in said casing for storing ink discharged from a discharge opening;

an energy generating member in said casing for generating energy for discharging ink from the discharge opening;

electrical connecting means attached to said casing for receiving from the apparatus a signal for actuating said energy generating member while the cartridge is mounted on the apparatus;

a band-like member in said casing and having a closure portion for closing the discharge opening and an open portion enabling ink to be discharged through the discharge opening, said closure portion operating to prevent ink from clogging the discharge opening, and said open portion operating to open an entire area of the cartridge where the discharge opening is provided, said energy generating member generating energy when the open portion of said band-like member is aligned with the discharge opening; and driving force receiving means attached to said casing for receiving from the apparatus a drive force and moving said band-like member.

2. An ink jet cartridge according to claim 1, wherein said energy generating member is an electric-thermal converting member generating thermal energy.

3. An ink jet cartridge according to claim 1, wherein said band-like member is provided with a cap portion for capping the discharge opening.

4. An ink jet cartridge according to claim 1, wherein said band-like member is provided with a humid functioning portion for maintaining the discharge opening in a humid condition.

5. An ink jet cartridge according to claim 1, wherein said band-like member is provided with a cleaning portion for cleaning the discharging opening.

6. An ink jet cartridge according to claim 1, wherein said band-like member is configured as an endless loop.

7. An ink jet cartridge according to claim 1, wherein said band-like member has first and second ends.

8. A cartridge according to claim 1, further comprising the ink stored in said ink storing portion.

9. An ink jet cartridge removably mountable on a main body of an ink jet recording apparatus, said cartridge comprising:

a casing having means for removably mounting the cartridge on the apparatus;

an ink storing portion in said casing for storing ink discharged from a discharge opening;

an energy generating member in said casing for generating energy for discharging ink from the discharge opening;

electrical connecting means attached to said casing for receiving from the apparatus a signal for actuating said energy generating member;

a band-like member in said casing and having a closure portion for closing the discharge opening, an open portion enabling ink to be discharged through the discharge opening in a humid condition, said closure portion operating to prevent ink from clogging the discharge opening, and said open portion operating to open an entire area of the cartridge where the discharge opening is provided, said energy generating member generating energy when the open portion of said band-like member is aligned with the discharge opening;

means for applying a humidifying agent to said humid functioning portion; and driving force receiving means attached to said casing for receiving a drive force from the apparatus and moving said band-like member.

10. A cartridge according to claim 9, further comprising the ink stored in said ink storing portion.

11. An ink jet cartridge removably mountable on a main body of an ink jet recording apparatus, said cartridge comprising:

a casing having means for removably mounting the cartridge on the apparatus;

an ink storing portion in said casing for storing ink discharged from a discharge opening;

an energy generating member in said casing for generating energy for discharging ink from the discharge opening;

electrical connecting means attached to said casing for receiving from the apparatus a signal for actuating said energy generating member;

a band-like member in said casing and having a closure portion for closing the discharge opening, an open portion enabling ink to be discharged through the discharge opening and an electrostatic preventing layer, said closure portion operating to prevent ink from clogging the discharge opening, and said open portion operating to open an entire area of the cartridge where the discharge opening is provided, said energy generating member generating energy when the open portion of said bank-like member is aligned with the discharge opening; and driving force receiving means attached to said casing for receiving from the apparatus a drive force and moving said band-like member.

12. A cartridge according to claim 11, further comprising the ink stored in said storing portion.

13. An ink jet apparatus comprising:

an ink jet cartridge including a casing having means for removably mounting said cartridge on the apparatus, an ink storing portion in said casing for storing ink discharged from a discharge opening, an energy generating member in said casing for generating energy for discharging ink from the discharge opening, electrical connecting means attached to said casing for receiving from the apparatus a signal for actuating said energy generating member while said cartridge is mounted on the apparatus, a band-like member in said casing and having a closure portion for closing the discharge opening and an open portion enabling ink to be discharged from the discharge opening, said closure portion operating to prevent ink from clogging the discharge opening, and said open portion operating to open an entire area of the cartridge where the discharge opening is provided, said energy generating member generating energy when the open portion of said band-like member is aligned with the discharge opening, and driving force receiving means attached to said casing for receiving from the apparatus a drive force and moving said band-like member;

a main body having means for driving said cartridge to effect printing on a recording medium, said cartridge being removably mountable on said main body; and signal supply means for supplying the signal to said electrical connecting means when said cartridge is mounted to said main body.

14. An ink jet cartridge according to claim 13, wherein said energy generating member is an electric-thermal converting member generating thermal energy.

15. An apparatus according to claim 13, further comprising the ink stored in said ink storing portion.

16. An ink jet apparatus comprising:

an ink jet cartridge including a casing having means for removably mounting said cartridge on the apparatus, storing portion in said casing for storing ink discharged from a discharge opening, an energy generating member in said casing for generating energy for discharging ink from the discharge opening, electrical connecting means attached to said casing for receiving a signal for actuating said energy generating member while said cartridge is mounted on the apparatus, a band-like member in said casing and including a closure portion for closing the discharge opening and an open portion enabling ink to be discharged through the discharge opening, said closure portion operating to prevent ink from clogging the discharge opening, and said open portion operating to open an entire area of the cartridge where the discharge opening is provided, said energy generating member generating energy when the open portion of said band-like member is aligned with the discharge opening, and driving force receiving means attached to said casing for receiving from the apparatus a drive force and moving said band-like member;

a main body having means for driving said cartridge to effect printing on a recording medium, said cartridge being removably mountable on said main body; and drive force supply means for supplying the drive force to said driving force receiving means to move said band-like member when said cartridge is mounted on said main body.

17. An ink jet cartridge according to claim 16, wherein said energy generating member is an electric-thermal converting member generating thermal energy.

18. An apparatus according to claim 16, further comprising the ink stored in said ink storing portion.

19. An ink jet apparatus, comprising:

a main body having means for driving an ink jet cartridge to effect printing on a recording medium;

an ink jet cartridge removably mountable on said main body, said cartridge having a casing having means for removably mounting the cartridge on the apparatus, an ink storing portion in said casing for storing ink discharged from a discharge opening, an energy generating member in said casing for generating energy for discharging ink from the discharge opening, electrical connecting means attached to said casing for receiving from said apparatus a signal for actuating said energy generating member, a band-like member in said casing and having a closure portion for closing the discharge opening, an open portion enabling ink to be discharged through the discharge opening, and a humid functioning portion for maintaining the discharge opening in a humid condition, means for applying a humidifying agent to said humid functioning portion and driving force receiving means attached to said casing for receiving a driving force from said apparatus and moving said band-like member, said closure portion operating to prevent ink from clogging the discharge opening, and said open portion operating to open an entire area of the cartridge where the discharge opening is provided, said energy generating member generating energy when the open portion of said band-like member is aligned with the discharge opening; and signal supply means for supplying the signal to said electrical connecting means when said cartridge is mounted on said main body.

20. An apparatus according to claim 19, further comprising the ink stored in said ink storing portion.

21. An ink jet apparatus, comprising:

a main body having means for driving an ink jet cartridge to effect printing on a recording medium;

an ink jet cartridge removably mountable on said main body, said cartridge having a casing having means for removably mounting the cartridge on the apparatus, an ink storing portion in said casing for storing ink discharged from a discharge opening, an energy generating member in said casing for generating energy for discharging ink from the discharge opening, electrical connecting means attached to said casing for receiving from said apparatus a signal for actuating said energy generating member, a band-like member in said casing and having a closure portion for closing the discharge opening, an open portion enabling ink to be discharged through the discharge opening, and an electrostatic preventing layer, and driving force receiving means attached to said casing for receiving from said apparatus a drive force and moving said band-like member, said closure portion operating to prevent ink from clogging the discharge opening, and said open portion operating to open an entire area of the cartridge where the discharge opening is provided, said energy generating member generating energy when the open portion of said band-like member is aligned with the discharge opening; and signal supply means for supplying the signal to said electrical connecting means when said cartridge is mounted to said main body.

22. An apparatus according to claim 21, further comprising the ink stored in said ink storing portion.

23. An ink jet apparatus, comprising:

a main body having means for driving an ink jet cartridge to effect printing on a recording medium;

an ink jet cartridge removably mountable on said main body, said cartridge having a casing having means for removably mounting the cartridge on the apparatus, an ink storing portion in said casing for storing ink discharged from a discharge opening, an energy generating member in said casing for generating energy for discharging ink from the discharge opening, electrical connecting means attached to said casing for receiving from said apparatus a signal for actuating said energy generating member, a band-like member in said casing and having a closure portion for closing the discharge opening, an open portion enabling ink to be discharged through the discharge opening, and a humid functioning portion for maintaining the discharge opening in a humid condition, means for applying a humidifying agent to said humid functioning portion, and driving force receiving means attached to said casing for receiving a drive force from said apparatus and moving said band-like member, said closure portion operating to prevent ink from clogging the discharge opening, and said open portion operating to open an entire area of the cartridge where the discharge opening is provided, said energy generating member generating energy when the open portion of said band-like member is aligned with the discharge opening; and drive force supply means for supplying the drive force to said driving force receiving means when said cartridge is mounted on said main body.

24. An apparatus according to claim 23, further comprising the ink stored in said ink storing portion.

25. An ink jet apparatus comprising:

a main body having means for driving an ink jet cartridge to effect printing on a recording medium;

an ink jet cartridge removably mountable on said main body, said cartridge having a casing having means for removably mounting the cartridge on the apparatus, an ink storing portion in said casing for storing ink discharged from a discharge opening, an energy generating member in said casing for generating energy for discharging ink from the discharge opening, electrical connecting means attached to said casing for receiving from said apparatus a signal for actuating said energy generating member, a bank-like member in said casing and having a closure portion for closing the discharge opening, an open portion enabling ink to be discharge through the discharge opening, and an electrostatic preventing layer, and driving force receiving means attached to said casing for receiving a drive force from said apparatus and moving said band-like member, said closure portion operating to prevent ink from clogging the discharge opening, and said open portion operating to open an entire area of the cartridge where the discharge opening is provided, said energy generating member generating energy when the open portion of said band-like member is aligned with the discharge opening; and driving force supply means for supplying the drive force to said driving force receiving means when said cartridge is mounted on said main body.

26. An apparatus according to claim 25, further comprising the ink stored in said ink storing portion.

27. An ink jet apparatus comprising:

a main body having means for receiving an ink jet cartridge; and an ink jet cartridge removably mountable on said main body, said cartridge including a casing having means for removably mounting said cartridge on the apparatus, an ink storing portion in said casing for storing ink discharged from a discharge opening, an energy generating member in said casing for generating energy for discharging ink from the discharge opening, electrical connecting means attached to said casing for receiving from the apparatus a signal for actuating said energy generating member while said cartridge is mounted on the apparatus, a band-like member in said casing and having a closure portion for closing the discharge opening and an open portion enabling link to be discharged through the discharge opening, said closure portion operating to prevent ink from clogging the discharge opening, and said open portion operating to open an entire area of the cartridge where the discharge opening is provided, said energy generating member generating energy when the open portion of said band-like member is aligned with the discharge opening, and driving force receiving means attached to said casing for receiving from the apparatus a drive force and moving said band-like member, wherein said main body includes means for driving said cartridge to effect printing on a recording medium, and signal supply means for supplying the signal to said electrical connecting means when said cartridge is mounted to said main body.

28. An apparatus according to claim 27, further comprising the ink stored in said ink storing portion.

* * * * *

UNITED STATES PATENT AND TRADEMARK OFFICE

CERTIFICATE OF CORRECTION

PATENT NO. : 5,289,213

DATED : February 22, 1994

INVENTOR(S) : KEIICHI MURAI, ET AL.

It is certified that error appears in the above-identified patent and that said Letters Patent is hereby corrected as shown below:

COLUMN 1

Line 16, "use for" should read --for use with--.

COLUMN 3

Line 1, "or" should be deleted.
Line 12, "ca" should read --can--.
Line 38, "view" should read --view of--.

COLUMN 4

Line 1, "FIGS. 17A" should read --FIG. 17A--.

COLUMN 9

Line 5, "If" should read --It--.
Line 10, "If" should read --It--.
Line 55, "maintained a" should read --maintained in a--.

COLUMN 10

Line 26, "allows to compactize the" should be deleted.
Line 39, "humidifying of the" should read --of the humidifying--.

COLUMN 15

Line 17, "head 110 a" should read --head 110 during a--.

UNITED STATES PATENT AND TRADEMARK OFFICE

CERTIFICATE OF CORRECTION

PATENT NO. : 5,289,213

DATED : February 22, 1994

INVENTOR(S) : KEIICHI MURAI, ET AL.

It is certified that error appears in the above-identified patent and that said Letters Patent is hereby corrected as shown below:

COLUMN 17

Line 56, "cl Embodi-" should be deleted.
Line 57, "ment 3" should read --Embodiment 3--.

COLUMN 20

Line 9, "of" should be deleted.

COLUMN 22

Line 40 should be deleted.

COLUMN 23

Line 26, "copolymre" should read --copolymer--.

COLUMN 26

Line 3, "is remained," should read --remains,--.
Line 11, "the" (first occurrence) should be deleted.

COLUMN 27

Line 10, "complexed." should read --complex--.
Line 57, "the" (first occurrence) should be deleted.

COLUMN 28

Line 67, "opening in" should read --opening and a humid functioning portion for maintaining the discharge opening in--.

UNITED STATES PATENT AND TRADEMARK OFFICE

CERTIFICATE OF CORRECTION

PATENT NO. : 5,289,213

DATED : February 22, 1994

INVENTOR(S) : KEIICHI MURAI, ET AL.

It is certified that error appears in the above-identified patent and that said Letters Patent is hereby corrected as shown below:

COLUMN 29

Line 36, "bank-like" should read --band-like--.

COLUMN 30

Line 32, line 30, "bank-like" should read --band-like--.
Line 8, "ink jet cartridge" should read --apparatus--.

COLUMN 32

Line 32, line 30, "bank-like" should read --band-like--.
Line 33, "discharge" should read --discharged--.
Line 66, "link" should read --ink--.

Signed and Sealed this

First Day of November, 1994

Bruce Lehman

*Attest:*

BRUCE LEHMAN

*Attesting Officer*

*Commissioner of Patents and Trademarks*